United States Patent [19]

Kato et al.

[11] Patent Number: 5,073,471

[45] Date of Patent: Dec. 17, 1991

[54] LIQUID DEVELOPER FOR ELECTROSTATIC PHOTOGRAPHY

[75] Inventors: Eiichi Kato; Hideyuki Hattori, both of Shizuoka, Japan

[73] Assignee: Fuji Photo Film Co., Ltd., Kanagawa, Japan

[21] Appl. No.: 476,190

[22] Filed: Feb. 7, 1990

[30] Foreign Application Priority Data

Feb. 8, 1989 [JP] Japan ..... 1-27628
Oct. 31, 1989 [JP] Japan ..... 1-282026

[51] Int. Cl.[5] ..... G03G 9/13

[52] U.S. Cl. ..... 430/114; 430/115; 430/137

[58] Field of Search ..... 430/114, 115, 137, 904

[56] References Cited

U.S. PATENT DOCUMENTS 4,837,102 6/1989 Dan et al. ..... 430/115
4,840,865 6/1989 Kato et al. ..... 430/115
4,977,055 12/1990 Kato et al. .
5,006,441 4/1991 Kato .

*Primary Examiner*—John Goodrow
*Attorney, Agent, or Firm*—Sughrue, Mion, Zinn, Macpeak & Seas

[57] ABSTRACT

A liquid developer for electrostatic photography is disclosed. The liquid developer comprises resin grains dispersed in a non-aqueous solvent having an electric resistance of at least $10^9$ Ωcm and a dielectric constant of not higher than 3.5, wherein the dispersed resin grains are copolymer resin grains obtained by polymerizing a solution containing at least one kind of a monofunctional monomer (A), which is soluble in the above non-aqueous solvent but becomes insoluble therein by being polymerized, in the presence of a dispersion-stabilizing resin soluble in the non-aqueous solvent and an oligomer (B) having a number average molecular weight of not more than $1 \times 10^4$. The dispersion-stabilizing resin is a polymer containing at least a recurring unit represented by the formula (I) described in the specification, a part of which has been crosslinked, and has a double bond group which is copolymerizable with the monofunctional monomer (A) and which is bonded to only one terminal of at least one polymer main chain, and the oligomer (B) is a polymer comprising a recurring unit represented by the formula (II) described in the specification and has at least one kind of a polar group. 2

9 Claims, No Drawings

LIQUID DEVELOPER FOR ELECTROSTATIC PHOTOGRAPHY

FIELD OF THE INVENTION

This invention relates to a liquid developer for electrophotography, which comprises resin grains dispersed in a liquid carrier having an electric resistance of at least $10^9$ Ωcm and a dielectric constant of not higher than 3.5, and more particularly to an electrophotographic liquid developer excellent in redispersibility, storability, stability, image-reproducibility, and fixability.

BACKGROUND OF THE INVENTION

In general, a liquid developer for electrophotography is prepared by dispersing an inorganic or organic pigment or dye such as carbon black, nigrosine, phthalocyanine blue, etc., a natural or synthetic resin such as an alkyd resin, an acrylic resin, rosine, synthetic rubber, etc., in a liquid having a high electric insulating property and a low dielectric constant, such as a petroleum aliphatic hydrocarbon, etc., and further adding a polarity-controlling agent such as a metal soap, lecithin, linseed oil, a higher fatty acid, a vinyl pyrrolidone-containing polymer, etc., to the resulting dispersion.

In such a developer, the resin is dispersed in the form of insoluble latex grains having a grain size of from several μm to several hundred μm. In a conventional liquid developer, however, a soluble dispersion-stabilizing resin added to the liquid developer and the polarity-controlling agent are insufficiently bonded to the insoluble latex grains, thereby the soluble dispersion-stabilizing resin and the polarity-controlling agent are in a state of easily dispersing in the liquid carrier. Accordingly, there is a fault that when the liquid developer is stored for a long period of time or repeatedly used, the dispersion-stabilizing resin is split off from the insoluble latex grains, thereby the latex grains are precipitated, aggregated, and accumulated to make the polarity thereof indistinct. Also since the latex grains once aggregated or accumulated are reluctant to re-disperse, the latex grains attach to everywhere in the developing machine, which results in causing stains of image formed and malfunctions of the developing machine, such as clogging of a liquid feed pump, etc.

For overcoming such defects, a means of chemically bonding the soluble dispersion-stabilizing resin and the insoluble latex grains is disclosed in U.S. Pat. No. 3,990,980. However, the liquid developer disclosed therein is still insufficient although the dispersion stability of the grains to the spontaneous precipitation may be improved to some extent and when the liquid developer is actually used in a developing apparatus, there occurs a fault that the toner attached to parts of the developing apparatus is solidified in the form of coating and the toner grains thus solidified are reluctant to re-disperse and are insufficient in redispersion stability for practical use, which causes the malfunction of the apparatus and staining of duplicated images.

In accordance with the method of preparing the resin grains as disclosed in U.S. Pat. No. 3,990,980, there is an extreme limitation on the combination of the dispersing stabilizer to be used and the monomers to be insolubilized, in order to prepare monodispersed grains having a narrow grain size distribution. Mostly, the resin grains prepared by the method would contain a large amount of coarse grains having a broad grain size distribution, or would be polydispersed grains having two or more different mean grain sizes. In accordance with such a method, it is difficult to obtain monodispersed grains having a narrow grain size distribution and having a desired mean grain size, and the method often results in large grains having a grain size of 1 μm or more, or extremely fine grains having a grain size of 0.1 μm or less. In addition, the dispersion stabilizer to be used in the method has another problem in that it must be prepared by an extremely complicated process requiring a long reaction time.

In order to overcome the aforesaid defects, a method of forming insoluble dispersion resin grains of a copolymer from a monomer to be insolubilized and a monomer containing a long chain alkyl moiety, so as to improve the dispersibility, re-dispersibility and storage stability of the grains, has been disclosed in JP-A-60-179751 and JP-A-62-151868 (the term "JP-A" as used herein means an "unexamined published Japanese patent application").

Also, a method of forming insoluble dispersion resin grains by polymerizing a monomer being insolubilized in the presence of a polymer utilizing a di-functional monomer or a polymer utilizing a macromolecular reaction for improving the dispersibility, the redispersibility, and the storage stability is disclosed in JP A-60-185962 and JP-A 61 43757.

On the other hand, a method of printing a large number of prints of 5000 or more prints has recently been developed, using an offset printing master plate by electrophotography. In particular, because of further improvement of the master plate, it has become possible to print 10,000 or more prints of large size by electrophotography. In addition, noticeable progress has been made in shortening the operation time in an electrophotomechanical system, and the step of development-fixation in the system has been conveniently accelerated.

The grains prepared by the methods disclosed in aforesaid JP-A-60-179751 and JP-A-62-151868 might be good in the mono-dispersibility, re-dispersibility, and storage stability of the grains, but showed unsatisfactory performance with respect to the printability for master plates of a large size and quickening of the fixation time.

Also, the dispersion resin grains prepared by the methods disclosed in aforesaid JP-A-60-185962 and JP-A-61-43757 were not always satisfactory in the points of the dispersibility and re-dispersibility of the grains and in the point of printability in the case of a shortened fixation time or in the case of master plates of a large size (e.g., A-3 size ($297\times420$ mm$^2$)) or larger.

SUMMARY OF THE INVENTION

This invention has been made for solving the aforesaid problems inherent in conventional liquid developers.

An object of this invention is to provide a liquid developer excellent in dispersion stability, redispersibility, and fixability, and in particular to provide a liquid developer excellent in dispersion stability, re-dispersibility, and fixability even in an electrophotomechanical system wherein the development-fixation step is quickened and master plates of a large size are used.

Another object of this invention is to provide a liquid developer capable of forming an offset printing plate having excellent ink-receptivity for printing ink and excellent printing durability by electrophotography.

Still another object of this invention is to provide a liquid developer suitable for various electrostatic photographies and various transfer systems in addition to the aforesaid uses.

A further object of this invention is to provide a liquid developer capable of being used for any liquid developer-using systems such as ink jet recording, cathode ray tube recording, and recording by pressure variation or electrostatic variation.

The aforesaid objects have been attained by the present invention as set forth hereinbelow.

That is, according to this invention, there is provided a liquid developer for electrostatic photography comprising resin grains dispersed in a non-aqueous solvent having an electric resistance of at least $10^9$ Ωcm and a dielectric constant of not higher than 3.5, wherein the dispersed resin grains are copolymer resin grains obtained by polymerizing a solution containing at least one kind of a monofunctional monomer (A), which is soluble in the aforesaid non-aqueous solvent but becomes insoluble therein by being polymerized, in the presence of a dispersion-stabilizing resin soluble in the non-aqueous solvent and an oligomer (B) having a number average molecular weight of not more than $1\times10^4$, said dispersion-stabilizing resin being a polymer containing at least a recurring unit represented by following formula (I), a part of which has been crosslinked, and having a double bond group copolymerizable with the monofunctional monomer (A) bonded to only one terminal of at least one polymer main chain, and said oligomer (B) being a polymer comprising a recurring unit represented by following formula (II) and having at least one kind of polar group selected from a carboxy group, a sulfo group, a hydroxy group, a formyl group, an amino group, a phosphono group, and

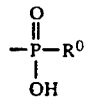

wherein $R^0$ represents a hydrocarbon group having from 1 to 8 carbon atoms or $—OR^1$ (wherein $R^1$ represents a hydrocarbon group having from 1 to 8 carbon atoms) bonded to only one terminal of the main chain of the polymer;

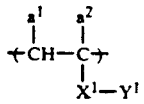

(I)

wherein $X^1$ represents —COO—, —OCO—, $—CH_2OCO—$, $—CH_2COO—$, —O—, or $—SO_2—$; $Y^1$ represents a hydrocarbon group having from 6 to 32 carbon atoms; and $a^1$ and $a^2$, which may be the same or different, each represents a hydrogen atom, a halogen atom, a cyano group, a hydrocarbon group having from 1 to 8 carbon atoms, $—COO—Z^1—$, or $—COO—Z^1$ bonded via a hydrocarbon group having from 1 to 8 carbon atoms (wherein $Z^1$ represents a hydrogen atom or a hydrocarbon group having from 1 to 18 carbon atoms)

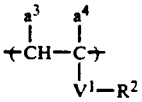

(II)

wherein $V^1$ represents —COO—, —OCO—, $—CH_2—COO—$, $—CH_2)—OCO—$, —O—, $—SO_2—$, —CONHCOO—, —CONHCONH—,

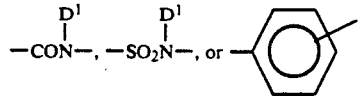

(wherein $D^1$ represents a hydrogen atom or a hydrocarbon group having from 1 to 22 carbon atoms and represents an integer of from 1 to 3); $R^2$ represents a hydrocarbon group having from 1 to 22 carbon atoms, said $R^2$ may have —O—, —CO—, $—CO_2—$,

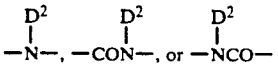

(wherein $D^2$ has the same meaning as $D^1$ described above); and $a^3$ and $a^4$, which may be the same or different, each represents a hydrogen atom, a halogen atom, a cyano group, a hydrocarbon group having from 1 to 8 carbon atoms, $—COO—D^3$, or $—COO—D^3$ bonded via a hydrocarbon group having from 1 to 8 carbon atoms (wherein $D^3$ represents a hydrogen atom or a hydrocarbon group having from 1 to 8 carbon atoms which may be substituted).

DETAILED DESCRIPTION OF THE INVENTION

Then, the liquid developer of this invention is described in detail.

As the liquid carrier for the liquid developer of this invention having an electric resistance of at least $10^9$ Ωcm and a dielectric constant of not higher than 3.5, straight chain or branched aliphatic hydrocarbons, alicyclic hydrocarbons, aromatic hydrocarbons, and halogen-substituted derivatives thereof can be preferably used. Examples thereof are octane, isooctane, decane, isodecane, decalin, nonane, dodecane, isododecane, cyclohexane, cyclooctane, cyclodecane, benzene, toluene, xylene, mesitylene, Isopar E, Isopar G, Isopar H, Isopar L (Isopar is a trade name of Exxon Co.), Shellsol 70, Shellsol 71 (Shellsol is a trade name of Shell Oil Co.), Amsco OMS and Amsco 460 Solvent (Amsco is a trade name of American Mineral Spirits Co.). They may be used singly or as a combination thereof.

The non-aqueous dispersed resin grains (hereinafter, often referred to as "dispersion resin grains" or "latex grains") which are the most important constituting element in this invention are resin grains produced by polymerizing (so-called polymerization granulation method) the aforesaid monofunctional monomer (A) in the presences of a dispersion-stabilizing resin soluble in the non-aqueous solvent and the aforesaid oligomer (B) in a non-aqueous solvent, said dispersion-stabilizing resin being a polymer containing at least a recurring unit represented by the aforesaid formula (I), a part of which has been crosslinked, and having a double bond group copolymerizable with the monofunctional monomer (A) bonded to only one terminal of at least one polymer main chain.

As the non-aqueous solvent for use in this invention, any solvents miscible with the aforesaid liquid carrier for the liquid developer for electrostatic photography can be basically used in this invention.

That is, the non-aqueous solvent being used in the production of the dispersion resin grains may be any solvent miscible with the aforesaid liquid carrier and preferably includes straight chain or branched aliphatic hydrocarbons, alicyclic hydrocarbons, aromatic hydrocarbons, and halogen-substituted derivatives thereof. Specific examples thereof are hexane, octane, isooctane, decane, isodecane, decalin, nonane, isododecane, and isoparaffinic petroleum solvents such as Isopar E, Isopar G, Isopar H, Isopar L, Shellsol 70, Shellsol 71, Amsco OMS and Amsco 460. They may be used singly or as a combination thereof.

Other solvents which can be used together with the aforesaid organic solvents in this invention include alcohols (e.g., methanol, ethanol, propyl alcohol, butyl alcohol, and fluorinated alcohols), ketones (e.g., acetone, methyl ethyl ketone, and cyclohexanone), carboxylic acid esters (e.g., methyl acetate, ethyl acetate, propyl acetate, butyl acetate, methyl propionate, and ethyl propionate), ethers (e.g., diethyl ether, dipropyl ether, tetrahydrofuran, and dioxane), and halogenated hydrocarbons (e.g., methylene dichloride, chloroform, carbon tetrachloride, dichloroethane, and methylchloroform).

It is preferred that the non-aqueous solvents which are used as a mixture thereof are distilled off by heating or under a reduced pressure after the polymerization granulation. However, even when the solvent is carried in the liquid developer as a dispersion of the latex grains, it gives no problem if the liquid electric resistance of the developer is in the range of satisfying the condition of at least $10^9$ Ωcm.

In general, it is preferred that the same solvent as the liquid carrier is used in the step of forming the resin dispersion and, as such a solvent, there are straight chain or branched aliphatic hydrocarbons, alicyclic hydrocarbons, aromatic hydrocarbons, halogenated hydrocarbons, etc., as described above.

It is a feature of this invention that the dispersion stabilizer (dispersion-stabilizing resin) in this invention, which is used for forming a stable resin dispersion of the polymer insoluble in a non-aqueous solvent formed by polymerizing the monofunctional monomer (A) in the non-aqueous solvent, is a resin soluble in the non-aqueous solvent and is a polymer containing at least a recurring unit shown by the aforesaid formula (I), a part of which has been crosslinked, and having a double bond copolymerizable with the aforesaid monomer bonded to only one terminal of at least one polymer main chain.

Then, the dispersion stabilizer (dispersion-stabilizing resin) in this invention is described in detail.

The hydrocarbon groups in the formula (I) showing the recurring unit of the polymer component may be substituted.

In the formula (I), $X^1$ represents preferably —COO—, —OCO—, —$CH_2$OCO—, or —$CH_2$COO—.

$Y^1$ in the formula represents preferably a hydrocarbon group having from 8 to 22 carbon atoms and practical examples thereof are aliphatic groups such as octyl, decyl, dodecyl tridecyl, tetradecyl, hexadecyl, octadecyl, docosanyl, eicosanyl, octenyl, decenyl, dodecenyl, tridecenyl, tetradecenyl, hexadecenyl, octadecenyl, dococenyl, etc.

In the formula (I), $a^1$ and $a^2$, which may be the same or different, each represents preferably a hydrogen atom, a halogen atom (e.g., fluorine, chlorine, and bromine), a cyano group, a hydrocarbon group having from 1 to 6 carbon atoms (e.g., methyl, ethyl, propyl, butyl, and phenyl), —COO—$Z^1$ or —COO—$Z^1$ bonded via a hydrocarbon atom having from 1 to 6 carbon atoms wherein $Z^1$ represents a hydrogen atom or a hydrocarbon group having from 1 to 18 carbon atoms (e.g., methyl, ethyl, propyl, butyl, hexyl, octyl, decyl, dodecyl, tridecyl, tetradecyl, hexadecyl, octadecyl, butenyl, hexenyl, octenyl, decenyl, benzyl, phenethyl, phenyl, chlorobenzyl, bromobenzyl, methylbenzyl, chlorophenyl, bromophenyl, and tolyl). More preferably, one of $a^1$ and $a^2$ is a hydrogen atom.

The dispersion-stabilizing resin in this invention may further contain other recurring unit(s) than the recurring unit shown by the formula (I) as the recurring unit(s) of the polymer main chain of the resin.

As such recurring units other than the recurring unit shown by the formula (I), any monofunctional monomer copolymerizable with the monomer corresponding to the recurring unit shown by the formula (I) can be used.

Practically, as such other recurring units, there is, for example, a recurring unit represented by formula (III);

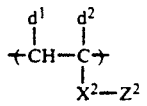

(III)

wherein $X^2$ represents

—COO—, —OCO—, —$CH_2$OCO—, —$CH_2$COO—, —$SO_2$—,

—O—, —S—, —CON(W¹)—, —$SO_2$N(W¹)—, —NHCO—, —$CH_2$NHCO,

—$NHSO_2$—, —$CH_2NHSO_2$—, —CONHCOO—,

—$CONHSO_2$—, —NHCONH—, or

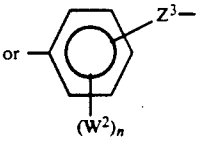

wherein $W^1$ represents a hydrogen atom or a hydrocarbon group having from 1 to 18 carbon atoms, which may be substituted (e.g., methyl, ethyl, propyl, butyl, hexyl, octyl, decyl, dodecyl tridecyl, octadecyl, 2-hydroxyethyl, 3-hydroxypropyl, 2-chloroethyl, 2-cyanoethyl, 2-methoxycarbonylethyl, 2-carboxyethyl, butenyl, hexenyl, octenyl, cyclohexyl, benzyl, phenethyl, phenyl, tolyl, naphthyl, chlorophenyl, bromophenyl, methoxyphenyl, bromobenzyl, methylbenzyl, and methoxybenzyl); $W^2$ represents a hydrogen atom, a halogen atom (e.g., fluorine, chlorine, and bromine), an alkyl group (e.g., methyl, ethyl, propyl, chloromethyl, hydroxymethyl, N,N-dimethylaminomethyl, and N,N-diethylaminomethyl), a hydroxy group, a carboxy group, or a sulfo group; n represents an integer of from 1 to 4; and $Z^3$ represents a linkage group or a bond of linking Z2 to the benzene ring and includes —COO—, —CON—, —$CH_2O$—, $$-COO-,\ -\underset{\underset{W^3}{|}}{CON}-,\ -CH_2O-,\ -\underset{\underset{W^3}{|}}{CH_2N}-,\ -O-,\ -S-,$$

$$-\underset{\underset{W^3}{|}}{SO_2N}-,$$

and a direct bond between the benzene ring and $Z^2$, wherein $W^3$ has the same meaning as $W^1$.

In formula (III), $Z^2$ represents a hydrogen atom, a hydrocarbon group having from 1 to 6 carbon atoms which may be substituted (e.g., methyl, ,ethyl, propyl, butyl, heptyl, hexyl, cycloheptyl, cyclohexyl, hexenyl, and phenyl), an aliphatic group having from 1 to 22 carbon atoms which may be substituted (wherein examples of the substituent include a halogen atom (e.g., fluorine, chlorine, bromine, and iodine), —OH, —SH, —COOH, —$SO_3H$, —$SO_2H$, —$PO_3H_2$, —CN, —$CONH_2$, —$SO_2NH_2$, $$-N\begin{matrix} W^4 \\ W^5 \end{matrix}$$

(wherein $W^4$ and $W^5$ each has the same meaning as $W^1$), —$OCOW^6$, —O—$W^6$, —S—$W^6$, $$-\overset{\overset{W^6}{|}}{\underset{\underset{W^8}{|}}{Si}}-W^7,$$

—$COOW^6$, and —$SO_2W^6$ (wherein $W^6$, $W^7$, and $W^8$ each represents a hydrocarbon group having from 1 to 18 carbon atoms which may be substituted and practically has the same meaning as $W^1$)), a heterocyclic group (e.g., thiophene, pyran, furan, pyridine, morpholine piperidine, imidazole, benzimidazole, and thiazole rings), or an aromatic group which may be substituted (e.g., phenyl, naphthyl, tolyl, xylyl, mesityl, fluorophenyl, chlorophenyl, bromophenyl, dichlorophenyl, dibromophenyl, trifluoromethylphenyl, hydroxyphenyl, methoxyphenyl, carboxyphenyl, sulfophenyl, carboxyamidophenyl, sulfoamidophenyl, methoxycarbonylphenyl, acetamidophenyl, cyanophenyl, nitrophenyl, and methanesulfonylphenyl) and $d^1$ and $d^2$, which may be the same or different, each has the same meaning as $a^1$ or $a^2$ described above.

Furthermore the recurring unit which can be used together with the monomer corresponding to the recurring unit shown by the formula (I) may be monomers other than the aforesaid monomers corresponding to the recurring units shown by the formula (III), and examples of such monomers are maleic acid, maleic anhydride, itaconic anhydride, vinylnaphthalene, and vinyl heterocyclic compounds having a vinyl group directly substituted to the ring (e.g., vinylpyridine, vinylimidazole, vinylthiophene, vinylpyrrolidone, vinylbenzimidazole, and vinyltriazole).

The dispersion-stabilizing resin for use in this invention is a polymer containing a polymer component obtained by polymerizing a monomer corresponding to the recurring unit shown by the formula (I) as a homopolymer component or a copolymer component obtained by copolymerizing the monomer corresponding to the recurring unit shown by the formula (I) and other monomer copolymerizable with the aforesaid monomer (e.g., the monomer corresponding to the recurring unit shown by the afore said formula (III)), a part of which has been crosslinked, and having a polymerizable double bond group bonded to only one terminal of the polymer main chain.

When the dispersion-stabilizing resin in this invention contains a copolymer component obtained by copolymerizing the monomer corresponding to the recurring unit shown by the formula (I) and other monomer copolymerizable with the aforesaid monomer (e.g., the monomer corresponding to the recurring unit shown by the formula (III)), the proportion of the monomer corresponding to the recurring unit shown by the formula (I) is at least 30 parts by weight, preferably at least 50 parts by weight and more preferably at least 70 parts by weight per 100 parts by weight of the whole monomers.

For introducing a crosslinked structure into the polymer, a conventionally known method can be used.

For example, there are a method of polymerizing the aforesaid monomer in the co-existence of a polyfunctional monomer and a method of incorporating a functional group of proceeding crosslinking to the polymer of the aforesaid monomer and causing crosslinking by a macromolecular reaction. In this case, a method of copolymerizing a monomer having two or more polymerizable functional groups and the monomer corresponding to the recurring unit shown by the formula (I) to crosslink the polymer chains is preferred.

Practical examples of the polymerizable functional group which can be used for the aforesaid reaction are $CH_2{=}CH-$, $CH_2{=}CH-CH_2-$, $$CH_2{=}CH-,\ CH_2{=}CH-CH_2-,\ CH_2{=}CH-\overset{\overset{O}{\|}}{C}-O-,$$

$$CH_2{=}\overset{\overset{CH_3}{|}}{C}-\underset{\underset{O}{\|}}{C}-O-,\ \overset{\overset{CH_3}{|}}{CH}{=}CH-\overset{\overset{O}{\|}}{C}-O-,\ CH_2{=}CH-CONH-,$$

$$CH_2{=}\overset{\overset{CH_3}{|}}{C}-CONH-,\ CH_2{=}CH-CONHCOO-,$$

$$CH_2{=}\overset{\overset{CH_3}{|}}{C}-CONHSO_2-,\ \overset{\overset{CH_3}{|}}{CH}{=}CH-CONHSO_2-,$$

$$\overset{\overset{CH_3}{|}}{CH}{=}CH-CONH-,\ CH_2{=}CH-O-\overset{\overset{O}{\|}}{C}-,$$

$$CH_2{=}\overset{\overset{CH_3}{|}}{C}-O-\overset{\overset{O}{\|}}{C}-,\ CH_2{=}CH-CH_2-O-\overset{\overset{O}{\|}}{C}-,$$

$$CH_2{=}CH-NHCO-,\ CH_2{=}CH-CH_2-NHCO-,$$

$$CH_2{=}CH-SO_2-,\ CH_2{=}CH-CO-,$$

$$CH_2{=}CH-O-,\ \text{and}\ CH_2{=}CH-S-.$$

In the monomer having two or more polymerizable functional groups, the functional groups may be the same or different.

Specific examples of the monomer having two or more polymerizable functional groups are as follows.

Examples of the monomer having the same polymerizable functional groups are styrene derivatives such as divinylbenzene, trivinylbenzene, etc.; esters of methacrylic acid, acrylic acid or crotonic acid, vinyl ethers, or allyl ethers of polyhydric alcohols ( e.g., ethylene glycol, diethylene glycol, triethylene glycol, polyethylene glycols #200, #400, and #600, 1,3-butylene glycol, neopentyl glycol, dipropylene glycol, polypropylene glycol, trimethylolpropane, trimethylolethane, and pentaerythritol) or polyhydroxyphenol (e.g., hydroquinone, resorcinol, catechol); vinyl esters, allyl esters, vinyl amides or allyl amides of dibasic acids (e.g., malonic acid, succinic acid, glutaric acid, adipic acid, pimelic acid, maleic acid, phthalic acid, and itaconic acid); and condensation products of polyamides (e.g., ethylenediamine, 1,3-propylenediamine, and 1,4-butylenediamine) and carboxylic acid having a vinyl group (e.g., methacrylic acid, acrylic acid, crotonic acid, and allylacetic acid).

Also, examples of the monomer having different polymerizable functional groups are vinyl-containing ester derivatives or amide derivatives (e.g., vinyl methacrylate, vinyl acrylate, vinyl itaconate, allyl methacrylate, allyl acrylate, allyl itaconate, vinyl methacryloylacetate, vinyl methacryloylpropionate, allyl methacryloylpropionate, methacrylic acid vinyloxycarbonyl methyl ester, acrylic acid vinyloxycarbonyl-methyloxycarbonylethylene ester, N-allylacrylamide, N-allylmethacrylamide, N-allylitaconic acid amide, and methacryloylpropionic acid allyl amide) of carboxylic acids having a vinyl group (e.g., methacrylic acid, acrylic acid, methacryloylacetic acid, acroylacetic acid, methacryloylpropionic acid, acryloylpropionic acid, itacoroylacetic acid, itacoroylpropionic acid, and reaction products carboxylic acid anhydrides and alcohols or amines (e.g., allyloxycarbonylpropionic acid, allyloxycarbonylacetic acid, 2-allyloxycarbonylbenzoic acid, and allylaminocarbonylpropionic acid)); and condensation products of aminoalcohols (e.g., aminoethanol, 1-aminopropanol, 1-aminobutanol, 1-aminohexanol, and 2-aminobutanol) and carboxylic acids having a vinyl group.

In the present invention, the monomer having two or more polymerizable functional groups can be used in an amount of less than about 15% by weight, and preferably less than about 10% by weight, based on the amount of the whole monomers, whereby the partially cross-linked resin can be formed.

The polymerizable double bond group bonded to only one terminal of the polymer main chain has a chemical structure wherein the double bond group is bonded to one terminal of the polymer main chain directly or through an optional linkage group.

Practically, the polymerizable double bond has a chemical structure shown, for example, by the following formula (IV);

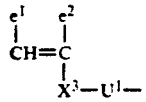

(IV)

wherein $X^3$ has the same meaning as $X^2$ in the formula (III); $e^1$ and $e^2$, which may be the same or different, each has the same meaning as $d^1$ or $d^2$ in the formula (III); $U^1$ represents a bond of directly bonding

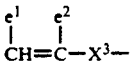

to one terminal of the polymer main chain or a bond group of bonding them through an optional linkage group.

The bond group is composed of an optional combination of an atomic group of a carbon-carbon bond (single bond or double bond), a carbon-hetero atom bond (examples of the hetero atom are oxygen, sulfur, nitrogen, and silicon), and a hetero atom-hetero atom bond.

Examples thereof are

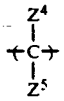

(wherein $Z^4$ and $Z^5$ each represents a hydrogen atom, a halogen atom (e.g., fluorine, chlorine, and bromine}, a cyano group, a hydroxy group, an alkyl group (e.g., methyl, ethyl and propyl)), —CH=CH—,

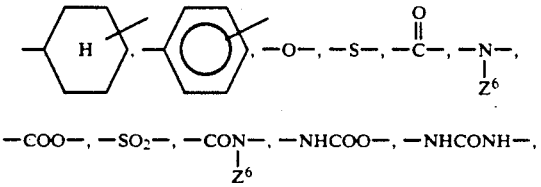

and $Z^7$ each represents a hydrogen atom, a hydrocarbon group having from 1 to 8 carbon atoms (e.g., methyl, ethyl, propyl, butyl, pentyl, hexyl, benzyl, phenethyl, phenyl, and tolyl), or $—OZ^8$ (wherein $Z^8$ is the same as the hydrocarbon group in $Z^6$ described above).

Then, specific examples of the polymerizable double bond shown by the formula (IV) ar illustrated below. In the following formulae, A represents —H, $—CH_3$, or $—CH_2COOCH_3$; B represents —H or $—CH_3$; n represents an integer of from 2 to 10; m represents 2 or 3; l represents 1, 2 or 3; p represents an integer of from 1 to 4; and q represents 1 or 2.

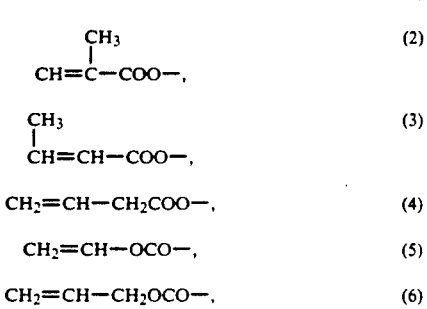

(1)

(2)

(3)

(4)

(5)

(6)

-continued (7)

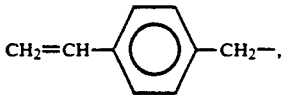

(8)

$CH_2{=}\overset{A}{\overset{|}{C}}{-}COO(CH_2)_nOCO{-},$ (9)

$CH_2{=}\overset{A}{\overset{|}{C}}{-}COOCH_2\underset{OH}{\underset{|}{C}}HCH_2OOC{-},$ (10)

$CH_2{=}\overset{A}{\overset{|}{C}}$
$|$
$COO(CH_2)_nS{-},$ (11)

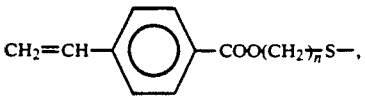

(12)

$CH_2{=}\overset{A}{\overset{|}{C}}$
$|$
$CONH(CH_2)_nS{-},$ (13)

$CH_2{=}\overset{A}{\overset{|}{C}}$
$|$
$COO(CH_2)_nCONH(CH_2)_2S{-},$ (14)

$CH_2{=}CH$
$|$
$SO_2CH_2CH_2CONH(CH_2)_2S{-},$ (15)

$CH_2{=}\overset{A}{\overset{|}{C}}$
$|$
$COO(CH_2)_nS{-},$ (16)

$CH_2{=}\overset{A}{\overset{|}{C}}$
$|$
$COO(CH_2)_nCOO(CH_2)_2S{-},$ (17)

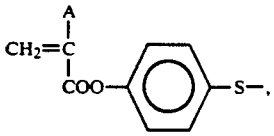

(18)

$CH_2{=}\overset{A}{\overset{|}{C}}$
$|$
$CONH(CH_2)_nCOO(CH_2)_2S{-},$ (19)

$CH_2{=}CH{-}CH_2COO(CH_2)_nS{-},$ (20)

$CH_2{=}\overset{A}{\overset{|}{C}}$
$|$
$COO(CH_2)_2OCO(CH_2)_m{-}COO(CH_2)_2S{-},$ (21)

$CH_2{=}\overset{A}{\overset{|}{C}}$
$|$
$COO(CH_2)_2OCOCH{=}CH{-}COO(CH_2)_3S{-},$ -continued (22)

$CH_2{=}\overset{CH_3}{\overset{|}{C}}$
$|$
$CONHCOO(CH_2)_2S{-},$ (23)

$CH_2{=}\overset{CH_3}{\overset{|}{C}}$
$|$
$CONHCONH(CH_2)_2S{-},$ (24)

$CH_2{=}CH{-}OCO(CH_2)_lS{-},$ (25)

$CH_2{=}CH{-}CH_2{-}OCO{-}(CH_2)_lS{-},$ (26)

$CH_2{=}\overset{A}{\overset{|}{C}}{-}COOCH_2\overset{OH}{\overset{|}{C}}HCH_2OOC(CH_2)_lS{-},$ (27)

$\overset{B}{\overset{|}{C}}H{=}CH{-}COOCH_2\overset{OH}{\overset{|}{C}}HCH_2OOC(CH_2)_lS{-},$ (28)

$CH_2{=}\overset{A}{\overset{|}{C}}{-}COOCH_2\overset{OH}{\overset{|}{C}}HCH_2NH(CH_2)_nS{-},$ (29)

$CH_2{=}\overset{A}{\overset{|}{C}}{-}COO{+}CH_2{\rightarrow}_p\overset{CH_3}{\overset{|}{\underset{CN}{\underset{|}{C}}}}{-},$ (30)

$CH_2{=}\overset{A}{\overset{|}{C}}{-}COO(CH_2)_nCOO{+}CH_2{\rightarrow}_p\overset{CH_3}{\overset{|}{\underset{CN}{\underset{|}{C}}}}{-},$ (31)

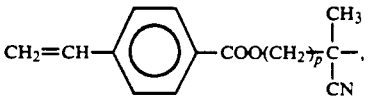

(32)

$CH_2{=}CH{-}CH_2COO(CH_2)_3\overset{CH_3}{\overset{|}{\underset{CN}{\underset{|}{C}}}}{-},$ (33)

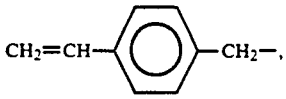

(34)

$CH_2{=}CH{-}CH_2OCO{-}CH_2CH_2\overset{CH_3}{\overset{|}{\underset{CN}{\underset{|}{C}}}}{-},$ (35)

$CH_2{=}CH{-}SO_2CH_2CH_2COOCH_2{-}\overset{CH_3}{\overset{|}{\underset{CN}{\underset{|}{C}}}}{-},$ (36)

$CH_2{=}\overset{A}{\overset{|}{C}}{-}COOCH_2\overset{OH}{\overset{|}{C}}HCH_2OOCCH_2S{-},$ (37)

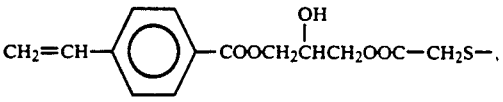

(38)

$CH_2{=}CH{+}CH_2{\rightarrow}_q COOCH_2\overset{OH}{\overset{|}{C}}HCH_2OOC{-}CH_2CH_2S{-},$ The dispersion-stabilizing resin in this invention having the polymerizable double bond group bonded to only one terminal of the polymer main chain can be easily produced by (1) a method of reacting various reagents to the terminal of a living polymer obtained by a conventionally known anion polymerization or cation polymerization or (2) a method of reacting a reagent having a "specific reactive group" (e.g., —OH, —COOH, $-SO_3H$, $-NH_2$, —SH, $-PO_3H_2$, —NCO, —NCS,

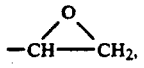

—COCl, and $-SO_2Cl$) to the terminal of the aforesaid living polymer and thereafter, introducing therein a polymerizable double bond group by a macromolecular reaction (both methods being a method by an ion polymerization method), or (3) a method of performing a radical polymerization using a polymerization initiator and/or a chain transfer agent each having the aforesaid "specific reactive group" in the molecule and, thereafter, introducing a polymerizable double bond group into the polymer obtained by performing a macromolecular reaction utilizing the "specific reactive group".

Practically, a polymerizable double bond group can be introduced into the polymer according to the method described in P. Dreyfuss & R.P. Quick, *Encycl. Polym. Sci. Eng.*, 7, 551 (1987), Yoshiki Nakajoo and Yuuya Yamashita, *Senryo to Yakuhin* (*Dyes and Chemicals*), 39, 232(1985), Akira Ueda and Susumu Nagai, *Kagaku to Kogyo* (*Science and Industry*), 60 57 (1986), P. F. Rempp & E Franta, *Advances in Polymer Science*, 58, 1(1984), Koichi Ito, *Kobunshi Kako* (*High Polymer Processing*), 35, 262(1986), V. Percec, *Applied Polymer Science*, 285, 97(1985), etc., and the literature references cited therein.

More practically, the polymer having a crosslinked structure and having the "specific reactive group" bonded to only one terminal is synthesized by (1) a method of polymerizing a mixture of at least one kind of the monomer corresponding to the recurring unit shown by the formula (I), the aforesaid polyfunctional monomer for introducing a crosslinked structure, and a chain transfer agent having the aforesaid "specific reactive group" in the molecule by a polymerization initiator (e.g., azobis series compounds and peroxides), (2) a method of polymerizing the aforesaid mixture excluding the aforesaid chain transfer agent using a polymerization initiator having the aforesaid "specific reactive group" in the molecule, or (3) a method of polymerizing the aforesaid mixture using the chain transfer agent and the polymerization initiator each having the aforesaid "specific reactive group" in the molecule. Then, a polymerizable double bond group is introduced by a polymer reaction into the polymer utilizing the "specific reactive group".

The chain transfer agents which can be used include, for example mercapto compounds having the "specific reactive group" or a substituent capable of being induced to the "specific reactive group" (e.g., thioglycolic thiomalic acid, thiosalicylic acid, 2-mercaptopropionic acid, 3-mercaptopropionic acid, 3-mercaptobutyric acid, N-(2-mercaptopropionyl)glycine, 2-mercaptonicotinic acid, 3-[N-(2-mercaptoethyl)carbamoyl]-propionic acid, 3-[N-(2-mercaptoethyl)amino]propionic acid, N-(3-mercaptopropionyl)aniline, 2-mercaptoethanesulfonic acid, 3-mercaptopropanesulfonic acid, 4-mercaptobutanesulfonic acid, 2-mercaptoethanol, 1-mercapto-2-propanol, 3-mercapto-2-butanol, mercaptophenol, 2-mercaptoethylamine, 2-mercaptoimidazole, and 2-mercapto-3-pyridinol) and iodized alkyl compounds having the "specific reactive group" or a substituent capable of being induced to the "specific reactive group" (e.g., indoacetic acid, iodopropionic acid, 2-iodoethanol, 2-iodoethanesulfonic acid, and 3-iodopropanesulfonic acid). In these compounds, the mercapto compounds are preferred.

Also, the polymerization initiators having the "specific reactive group" or a substituent capable of being induced to the "specific reactive group" include, for example, 4,4'-azobis(4-cyanovaleric acid), 4,4'-azobis(4-cyanovaleric acid chloride), 2,2'-azobis-(2-cyanopropanol), 2,2'-azobis(2-cyanopentanol), 2,2'-azobis[2-(5-hydroxy-3,4,5,6-tetrahydropyrimidin-2-yl)propane], 2,2'-azobis{2-methyl-N-[1,1-bis(hydroxymethyl)-2-hydroxyethyl]propionamide}, 2,2'-azobis{2-methyl-N-[1,1-bis(hydroxyethyl)ethyl]propionamide}, 2,2'-azobis[2 methyl-N-(2-hydroxyethyl)propionamide], and 2,2'-azobis(2-aminodipropane).

The amount of the chain transfer agent or the polymerization initiator is from 0.5 to 15 parts by weight and preferably from 1 to 10 parts by weight per 100 parts by weight of the whole monomers.

The dispersion-stabilizing agent in this invention is soluble in an organic solvent. Practically, at least 5 parts by weight of the dispersion-stabilizing resin may be dissolved in 100 parts by weight of toluene at 25° C.

The weight average molecular weight of the dispersion-stabilizing resin is from $1\times10^4$ to $1\times10^6$, and preferably from $2\times10^4$ to $5\times10^5$.

The monomer which is used for producing the non-aqueous dispersion resin (grains) in this invention is the monofunctional monomer (A) which is soluble in the non-aqueous solvent but becomes insoluble therein by being polymerized. Any monofunctional monomers which are soluble in the non-aqueous solvent but become insoluble by being polymerized can be used in the present invention.

Practical example thereof is a monomer represented by following formula (V);

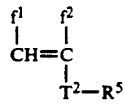

(V)

wherein $T^2$ represents —COO—, —OCO—, $-CH_2OCO-$, $-CH_2COO-$, —O—,

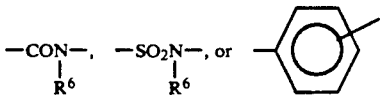

(wherein $R^6$ represents a hydrogen atom or an aliphatic group having from 1 to 18 carbon atoms which may be substituted (e.g., methyl, ethyl, propyl, butyl, 2-chloroethyl, 2-bromoethyl, 2-cyanoethyl, 2-hydroxyethyl, benzyl, chlorobenzyl, methylbenzyl, methoxybenzyl, phenethyl, 3-phenylpropyl, dimethylbenzyl, chlorobenzyl, 2-methoxyethyl, and 3-methoxypropyl)); $R^5$ represents a hydrogen atom or an aliphatic group having from 1 to 6 carbon atoms, which may be substituted (e.g., methyl, ethyl, propyl, butyl, 2-chloroethyl, 2,2-dichloroethyl, 2,2,2-trifluoroethyl, 2-bromoethyl, 2-glycidylethyl, 2-hydroxyethyl, 2-hydroxypropyl, 2,3-dihydroxypropyl, 2-hydroxy-3-chloropropyl, 2-cyanoethyl, 3-cyanopropyl, 2-nitroethyl, 2-methoxyethyl, 2-methanesulfonylethyl, 2-ethoxyethyl, N,N-dimethylaminoethyl, N,N-diethylaminoethyl, trimethoxysilylpropyl, 3-bromopropyl, 4-hydroxybutyl, 2-flufurylethyl, 2-thienylethyl, 2-pyridylethyl, 2-morpholinoethyl, 2-carboxyethyl, 3-carboxypropyl, 4-carboxybutyl, 2-phosphoethyl, 3-sulfopropyl, 4-sulfobutyl, 2-carboxyamidoethyl, 3-sulfoamidopropyl, 2-N-methylcarboxyamidoethyl, cyclopentyl, chlorocyclohexyl, and dichlorohexyl); and $f^1$ and $f^2$, which may be the same or different, each has the same meaning as $a^3$ or $a^4$ in the aforesaid formula (II).

Specific examples of the monomer (A) are vinyl esters or allyl esters of aliphatic carboxylic acids having from 1 to 6 carbon atoms (e.g., acetic acid, propionic acid, butyric acid, monochloroacetic acid, and trifluoropropionic acid); alkyl esters or amides having from 1 to 4 carbon atoms, which may be substituted, of unsaturated carboxylic acid such as acrylic acid, methacrylic acid, crotonic acid, itaconic acid, maleic acid, etc. (wherein examples of the alkyl moiety are methyl, ethyl, propyl, butyl, 2-chloroethyl, 2-bromoethyl, 2-fluoroethyl, trifluoroethyl, 2-hydroxyethyl, 2-cyanoethyl, 2-nitroethyl, 2-methoxyethyl, 2-methanesulfonylethyl, 2-benzenesulfonylethyl, 2-(N,N-dimethylamino)ethyl, 2-(N,N-diethylamino)ethyl, 2-carboxyethyl, 2-phosphoethyl, 4-carboxybutyl, 3-sulfopropyl, 4-sulfobutyl, 3-chloropropyl, 2-hydroxy-3-chloropropyl, 2-furfurylethyl, 2-pyridinylethyl, 2-thienylethyl, trimethoxypropyl, and 2 carboxyamidoethyl); styrene derivatives (e.g., styrene, vinyltoluene, α-methylstyrene, vinylnaphthalene, chlorostyrene, dichlorostyrene, bromostyrene, vinylbenzenecarboxylic acid, vinylbenzenesulfonic acid, chloromethyl, hydroxymethylstyrene, methoxymethylstyrene, N,N-dimethylaminomethylstyrene, vinylbenzenecarboxyamide, and vinylbenzenesulfoamide) unsaturated carboxylic acids such as acrylic acid, methacrylic acid, crotonic acid, maleic acid, itaconic acid, etc.; cyclic anhydrides of maleic acid and itaconic acid; acrylonitrile; methacrylonitrile; and heterocyclic compounds having a polymerizable double bond group (practically, the compounds described in *Polymer Data Handbook, Foundation,* pages 175 to 184, edited by Polymer Society of Japan, published by Baifukan, 1986, such as N-vinylpyridine, N-vinylimidazole, N-vinylpyrrolidone, vinylthiophene, vinyltetrahydrofuran, vinyloxazoline, vinylthiazole, N-vinylmorpholine, etc.

The aforesaid monomers (A) may be used singly or as a mixture thereof.

The dispersion resin grains are obtained by polymerizing the monofunctional monomer (A) in the presence of the aforesaid dispersion-stabilizing resin and the oligomer (B) as described above. The oligomer (B) is an oligomer having a number average molecular weight of not more than $1\times10^4$, and is a polymer composed of the recurring unit shown by the formula (II) and having the aforesaid specific polar group bonded to only one terminal of the main chain of the polymer.

The hydrocarbon groups included in $a^3$, $a^4$, $V^1$, and $R^2$ in the formula (II) each has the number of carbon atoms (as unsaturated hydrocarbon group) indicated above and each hydrocarbon group may be substituted.

In the formula (II), $D^1$ in the substituents shown by $V^1$ is a hydrogen atom or a hydrocarbon group having from 1 to 22 carbon atoms and preferred hydrocarbon group includes an alkyl group having from 1 to 22 carbon atoms which may be substituted (e.g., methyl, ethyl, propyl, butyl, heptyl, hexyl, octyl, nonyl, decyl, dodecyl, tridecyl, tetradecyl, hexadecyl, octadecyl, eicosanyl, docosanyl, 2-chloroethyl, 2-bromoethyl, 2-cyanoethyl, 2-methoxycarbonylethyl, 2-methoxyethyl, and 3-bromopropyl), an alkenyl group having from 4 to 18 carbon atoms which may be substituted (e.g., 2-methyl-1-propenyl, 2-butenyl, 2-pentenyl, 3-methyl-2-pentenyl, 1-pentenyl, 1-hexenyl, 2-hexenyl, 4-methyl-2-hexenyl, decenyl, dodecenyl, tridecenyl, hexadecenyl, octadecenyl, and linolenyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, and dimethoxybenzyl), an alicyclic group having from 5 to 8 carbon atoms which may be substituted (e.g., cyclohexyl, 2-cyclohexylethyl, and 2-cyclopentylethyl), or an aromatic group having from 6 to 12 carbon atoms, which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propioamidophenyl, and dodecyloxylamidophenyl).

When $V^1$ represents

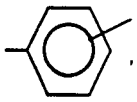

the benzene ring may have a substituent such as a halogen atom (e.g., chlorine and bromine), an alkyl group (e.g., methyl, ethyl, propyl, butyl, chloromethyl, and methoxymethyl), etc.

In the formula (II), $R^2$ represents preferably a hydrocarbon group having from 1 to 22 carbon atoms and, practically, has the same meaning as described on $D^1$. In this case, however, $R^2$ may have —O—, —CO—, —$CO_2$—, —OCO—, —$SO_2$—, $$-\overset{D^2}{\overset{|}{N}}-,\ -\overset{D^2}{\overset{|}{C}}ON-,\ \text{or}\ -\overset{D^2}{\overset{|}{N}}CO-$$

in the carbon chain.

In the above formulae, Dz has the same meaning as $D^1$.

In formula (II), $a^3$ and $a^4$, which may be the same or different, each represents preferably a hydrogen atom, a halogen atom (e.g., chlorine and bromine), a cyano group, an alkyl group having from 1 to 3 carbon atoms (e.g., methyl, ethyl, and propyl), —COO—$D^3$, or —$CH_2COOD^3$ (wherein $D^3$ represents a hydrogen atom, an alkyl group having from 1 to 18 carbon atoms, an alkenyl group, an aralkyl group, an alicyclic group, or an aryl group, each of these groups may be substituted, and specific examples of these groups are the same as those described above for $D^1$).

Furthermore, the recurring unit shown by the formula (II) constituting the oligomer (B) for use in this invention includes preferably a moiety (recurring unit) represented by following formula (IIa) having a feature that $R^2$ in the formula (II) has at least two specific polar groups (i.e., at least one specific polar group $X^{11}$ and at least one specific polar group $X^{22}$ as shown below);

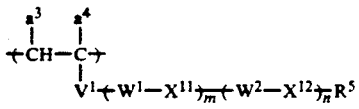

(IIa)

wherein $a^3$, $a^4$, and $V^1$ are same as defined above: $X^{11}$ and $X^{12}$, which may be the same or different, each represents —O—, —CO—, —$CO_2$—, —OCO—, —$SO_2$—,

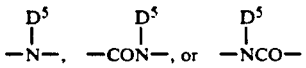

wherein $R^5$ has the same meaning as $D^1$ in the formula (II)); and $W^1$ and $W^2$, which may be the same or different, each represents a hydrocarbon group having from 1 to 18 carbon atoms (examples of the hydrocarbon group are an alkyl group, an alkenyl group, an aralkyl group, or an alicyclic group), which may be substituted or have

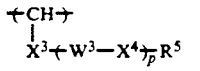

in the main chain bond (wherein $X^3$ and $X^4$, which may be the same or different, each has the same meaning as aforesaid $X^{11}$ or $X^{12}$ and $W^3$ represents a hydrocarbon group having from 1 to 18 carbon atoms, which may be substituted, and has the same meaning as $W^1$ or $W^2$ described above).

More practically, $W^1$ and $W^2$ of the formula (IIa) each is composed of an optional combination of the atomic group of

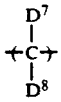

(wherein $D^7$ and $D^8$ each represents a hydrogen atom, an alkyl group, or a halogen atom),

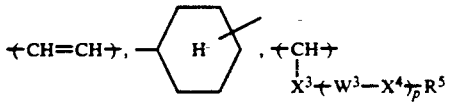

(wherein $X^3$, $X^4$, and $W^3$ are same as described above).

Furthermore, in the aforesaid formulae, m, n, and p, which may be the same or different, each represents an integer of from 0 to 3, with the proviso that m, n, and p cannot be 0 at the same time.

In the aforesaid formulae, $R^5$ represents a hydrogen atom or a hydrocarbon group having from 1 to 22 carbon atoms, is preferably an aliphatic group having from 1 to 22 carbon atoms, which may be substituted, and has practically the same meaning as $R^2$ in formula (II).

Furthermore, it is preferred that in the formula (IIa), the total atom number of each atomic group of $V^1$, $W^1$, $X^{11}$, $W^2$, $X^{12}$, and $R^5$ is at least 8.

Then, specific examples of the recurring unit shown by the formula (IIa) are illustrated below although the scope of this invention is not limited to them.

In addition, in the following formulae, represents —H or —$CH_3$; R represents an alkyl group having from 1 to 18 carbon atoms; R' represents a hydrogen atom or an alkyl group having from 1 to 18 carbon atoms; $k_1$ and $k_2$ each represents an integer of from 1 to 12; and $l_1$ represents an integer of from 1 to 100.

(A)-1

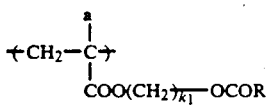

(A)-2

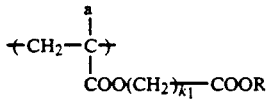

(A)-3

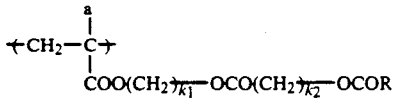

(A)-4

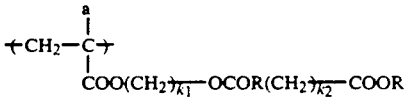

(A)-5

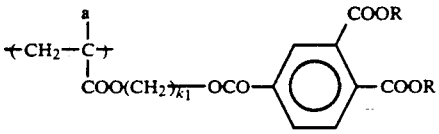

(A)-6

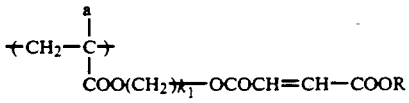

(A)-7

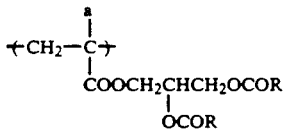

(A)-8

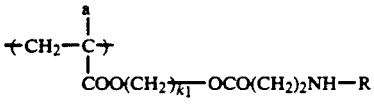

(A)-9

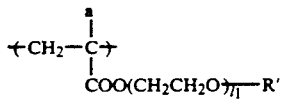

(A)-10

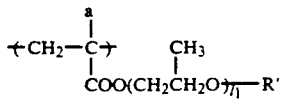

-continued (A)-11

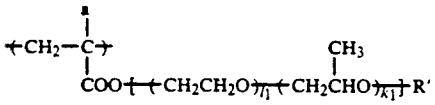

(A)-12

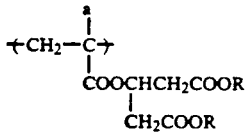

(A)-13

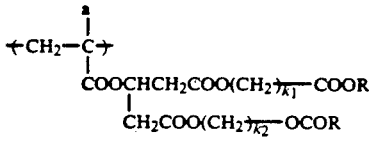

(A)-14

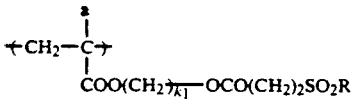

(A)-15

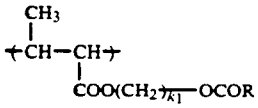

(A)-16

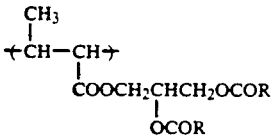

(A)-17

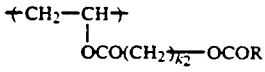

(A)-18

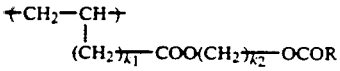

In

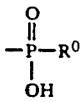

which is one of the aforesaid polar groups each bonded to only one terminal of the main chain of the polymer having a number average molecular weight of $1\times10^4$ and containing at least one kind of the recurring unit shown by the formula (II), $R^0$ represents $-R^1$ or $-OR^1$ (wherein $R^1$ represents a hydrocarbon group having from 1 to 18 carbon atoms).

Preferred examples of the hydrocarbon group shown by $R^1$ are an aliphatic group having from 1 to 8 carbon atoms, which may be substituted (e.g., methyl, ethyl, propyl, butyl, pentyl, hexyl, butenyl, pentenyl, hexenyl, 2-chloroethyl, 2-cyanoethyl, cyclopentyl, cyclohexyl, benzyl, phenethyl, chlorobenzyl, and bromobenzyl or an aromatic group which may be substituted (e.g., phenyl, tolyl, xylyl, mesityl, chlorophenyl, bromophenyl, methoxyphenyl, and cyanophenyl).

Also, the amino group in the polar groups described above represents $-NH_2$, $-NHR_9$, or

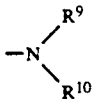

(wherein $R^9$ and $R^{10}$ each represents a hydrocarbon group having from 1 to 18 carbon atoms, and preferably a hydrocarbon group having from 1 to 8 carbon atoms. They are practically the same as the hydrocarbons shown by $R^1$ described above.

As more preferred examples of the hydrocarbon group shown by aforesaid $R^1$, $R^9$ and $R^{10}$, there are an alkyl group having from 1 to 4 carbon atoms, which may be substituted, a benzyl group which may be substituted or a phenyl group which may be substituted.

In this case, the polar group has a chemical structure that the group is bonded to one terminal of the polymer main chain directly or via an optional linkage group.

The polar group is bonded to one terminal of the main chain of the polymer directly or via an optional linkage group. The group linking the moiety (recurring unit) of formula (II) and the polar group is composed of an optional combination of the atomic group of a carbon-carbon bond (single bond or double bond), a carbon-hetero atom bond (examples of the hetero atom are oxygen, sulfur, nitrogen, and silicon), or a hetero atom-hetero atom bond.

Preferred oligomers in the oligomer (B) for use in this invention are shown by following formula (VIa) or (VIb);

(VIa)

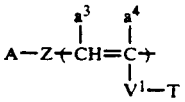

(VIb)

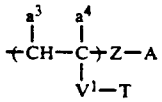

In the formulae (VIa) and (VIb), $a^3$, $a^4$, and $V^1$ are same as in the aforesaid formula (II); T represents $\text{-}(W^1-X^{11})_m(W^2-X^{12})_n-R^5$ in the formula (IIa); A represents the aforesaid polar group bonded to one terminal in the formula (II); and Z represents represents a single bond or a single linkage group selected from the atomic group

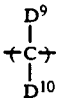

(wherein $D^9$ and $D^{10}$ each represents a hydrogen atom, a halogen atom (e.g., fluorine, chlorine, and bromine), a cyano group, a hydroxy group, or an alkyl group (e.g., methyl, ethyl, and propyl)),

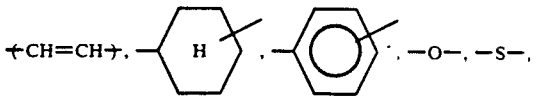

-continued

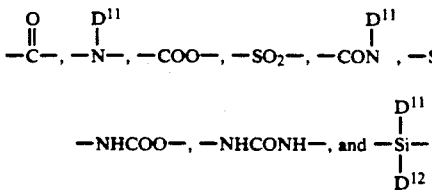

(wherein $D^{11}$ and $D^{12}$ each represents independently a hydrogen atom or the hydrocarbon group as in $D^1$ described above), or a linkage group composed of an optical combination of the aforesaid atomic groups.

If the number average molecular weight of the oligomer (B) is over $1\times10^4$, the press life of the master printing plate formed using the liquid developer is reduced. On the other hand, if the molecular weight is too less, there is a tendency of causing stains and hence the molecular weight is preferably higher than $1\times10^3$.

The oligomer (B) is composed of a homopolymer component of a copolymer component obtained by polymerizing or copolymerizing the monomer(s) corresponding to the recurring unit shown by formula (II) or a copolymer component obtained by copolymerizing the monomer corresponding to the recurring unit shown by the formula (II) and other monomer copolymerizable with the aforesaid monomer.

Other monomers which can be a copolymer component together with the polymer component of formula (II) include, for example, acrylonitrile, methacrylonitrile, heterocyclic compounds having a polymerizable double bond group (practically, the heterocyclic compounds described above on the monomer (A)), and compounds having a carboxyamido group or a sulfoamido group and a polymerizable double bond group (e.g., acrylamide, methacrylamide, diacetoneacrylamide, 2-carboxyamidoethyl methacrylate, vinylbenzenecarboxyamide, vinylbenzenesulfoamide, and 3-sulfoamidopropyl methacrylate).

The proportion of the recurring unit represented by the aforesaid formula (II) or (IIa) in the oligomer (B) for use in this invention is suitable from 30% by weight to 100% by weight, and preferably from 50% by weight to 100% by weight.

Also, it is preferred that the oligomer (B) does not contain a copolymer component having the polar group such as a phosphono group, a carboxy group, a sulfo group, a hydroxy group, a formyl group, an amino group, and

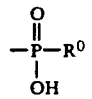

in the polymer main chain.

The oligomer (B) in this invention having the specific polar group bonded to only one terminal of the polymer main chain can be easily produced by (1) a method a reacting various reagents to the terminal of a living polymer obtained by an anion polymerization or a cation polymerization (a method by an ion polymerization), (2) a method of performing a radical polymerization using a polymerization initiator and/or a chain transfer agent each having the specific polar group in the molecule (a method by a radical polymerization), or (3) a method of forming a polymer having a reactive group at the terminal thereof by the aforesaid ion polymerization method or radical polymerization method and then converting the reactive group to the specific polar group of this invention by a polymer reaction.

Practically, the oligomer (A) can be produced by the methods described in P. Dreyfuss & R. P. Quirk, *Encycl. Polym. Sci. Eng*, 7, 551(1987), Yoshiki Nakajo & Yuuya Yamashita, *Senryo to Yakuhin* (*Dyes and Chemicals*), 30, 232(1985), and Akira Ueda & Susumu Nagai, *Kagaku to Kogyo* (*Science and Industry*), 60, 57(1986), and the publications cited in these literature references.

Examples of the aforesaid polymerization initiator having the specific polar group in the molecule are 4,4'-azobis(4-cyanovaleric acid), 4,4'-azobis( 4-cyanovaleric acid chloride), 2,2'-azobis(2-cyanopropanol), 2,2'-azobis[2-methyl-N-(2-hydroxyethyl)-propioamide], 2,2'-azobis{2-methyl-N-[1,1-bis(hydroxy-methyl)ethyl]-propioamide}, 2,2'-azobis{2-methyl-N-[1,1-bis(hydroxymethyl)-2-hydroxyethyl]propioamide}, 2,2'-azobis[2-(5-methyl-2-imidazolin-2-yl)propane], 2,2'-azobis[2-(4,5,6,7-tetrahydro-1H-1,3-diazepin-2-yl)propane], 2,2'-azobis[2-(3,4,5,6-tetrahydropyrimidin-2-yl)propane], 2,2'-azobis[2-(5-hydroxy-3,4,5,6-tetrapyrimidin-2-yl)propane], 2,2'-azobis{2-[1-(2-hydroxyethyl)-2-imidazolin-2-yl]propane}, 2,2'-azobis[N-(2-hydroxyethyl)-2-methylpropionamidine], and 2,2'-azobis-N-(4-aminophenyl)-2-methylpropionamidine].

Also, the chain transfer agent having the specific polar group in the molecule include, for example, mercapto compounds, disulfide compounds, and iodide-substituted compounds, but mercapto compounds are preferred. Specific examples thereof are thioglycolic acid, 2-mercaptopropionic acid, thiomalic acid, 2-mercaptoethanesulfonic acid, 2-mercaptoethanol, 2-mercaptoethylamine, thiosalicylic acid, α-thioglycerol, 2-phosphonoethylmercaptan, hydroxythiophenol, and derivatives of these mercapto compounds.

The amount of the polymerization initiator and/or the chain transfer agent is from 0.5% to 20% by weight, and preferably from 1 to 10% by weight per the total amount of the monomer corresponding to the recurring unit shown by formula (II) and, if any, other polymerizable monomer(s).

Preferred oligomers (B) used in this invention are those shown by the formula (VIa) or (VIb) described above, and specific examples of the moiety shown by A-Z-in these formulae are illustrated below, although the scope of this invention is not limited thereto.

In the following formulae, $k_1$ represents an integer of 1 or 2, $k_2$ represents an integer of from 2 to 16, and $k_3$ represents 1 or 3.

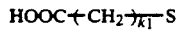

(B)-1

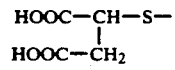

(B)-2

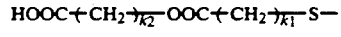

(B)-3

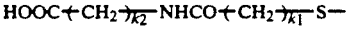

(B)-4

(B)-5

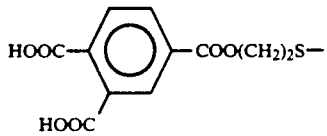

-continued
(B)-6
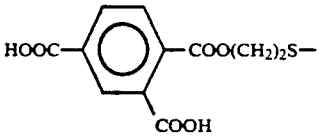
(B)-7
$HO(CH_2)_{k1}S-$
(B)-8
$H_2N(CH_2)_{k2}S-$
(B)-9
$HOCH(HOCH_2)-CH_2S-$
(B)-10
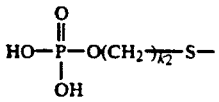
(B)-11
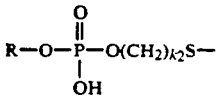
R: an alkyl group having 1 to 6 carbon atoms
(B)-12
$HO_3S(CH_2)_2S-$
(B)-13
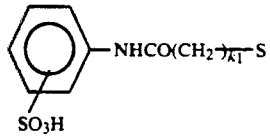
(B)-14
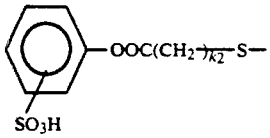
(B)-15
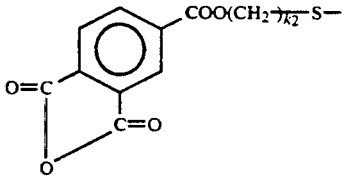
(B)-16
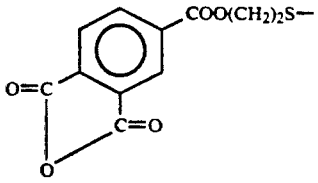
(B)-17
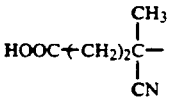
(B)-18
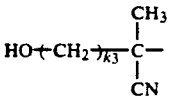
(B)-19
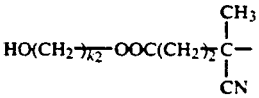
-continued
(B)-20
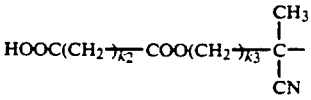
(B)-21
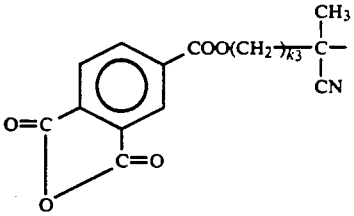
(B)-22
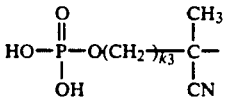
(B)-23
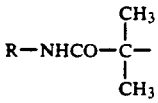
R: $HO(CH_2)_{l2}$, $H_3C-C(CH_2OH)_2-$
(B)-24
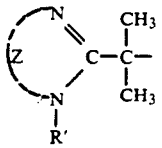
Z: $(CH_2)_3$, $(CH_2)_4$, $-CH_2CH(OH)CH_2-$
R': $-H$, $-CH_2CH_2OH$
(B)-25
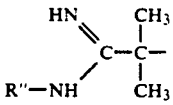
R'': $-CH_2CH_2OH$,
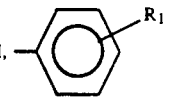
($R_1$: H, $-NH_2$, $-OH$)
(B)-26
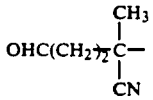
(B)-27
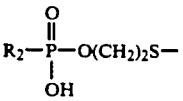
$R_2$: an alkyl group having 1 to 6 carbon atoms
(B)-28
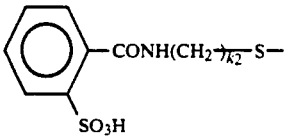
(B)-29
$HOOC(CH_2)_2NH(CH_2)_{k1}S-$ -continued $$HOOC(CH_2)_2CONH(CH_2)_{k2}S- \quad (B)\text{-}30$$

The dispersion resin grains in this invention are composed of at least one of the monomer (A) and at least one kind of the oligomer (B), and it is important that the resin composed of the monomers is insoluble in the non-aqueous solvent, whereby desired dispersion resin can be obtained. More practically, the oligomer composed of the monomer corresponding to the recurring unit shown by the formula (II) is used in an amount of preferably from 0.05 to 10% by weight, more preferably from 0.1 to 5% by weight, and particularly preferably from 0.3 to 3% by weight to the monomer (A) being insolubilized.

Also, the molecular weight of the dispersion resin in this invention is from $1\times10^3$ to $1\times10^6$, and preferably from $1\times10^4$ to $5\times10^5$.

The dispersion resin (grains) for use in this invention may be produced by polymerizing the monomer (A) under heating in the non-aqueous solvent in the presence of the aforesaid dispersion-stabilizing resin and the oligomer (B) using a polymerization initiator such as benzoyl peroxide, azibis-isobutyronitrile, butyl lithium, etc. Practically, the dispersion resin can be obtained by (1) a method of adding the polymerization initiator to a solution of the dispersion-stabilizing resin, the monomer (A), and the oligomer (B), (2) a method of adding dropwise the polymerization initiator to a solution of the dispersion-stabilizing resin with the addition of the monomer (A) and the oligomer (B), (3) a method of preparing a solution containing the whole amount of the dispersion-stabilizing resin and a part of a mixture of the monomer (A) and the oligomer (B) and adding thereto the remaining mixture of the monomer and the oligomer together with the polymerization initiator, or (4) a method of optionally adding a solution containing the dispersion-stabilizing resin, the monomer (A), and the oligomer (B) to a non-aqueous solvent together with the polymerization initiator.

The total amount of the monomer (A) and the oligomer (B) is from about 5 to about 80 parts by weight, and preferably from 10 to 50 parts by weight per 100 parts by weight of the non-aqueous solvent.

The amount of the soluble resin which is the dispersion stabilizing resin for the liquid developer of this invention is from about 1 to about 100 parts by weight, and preferably from 5 to 50 parts by weight per 100 parts by weight of the total amount of the monomers.

The amount of the polymerization initiator used is typically from about 0.1 to about 5% by weight based on the total amount of the monomers.

Also, the polymerization temperature is from about 50° C. to about 180° C., and preferably from 60° C. to about 120° C. The reaction time is preferably from about 1 to about 15 hours.

When the above-mentioned polar solvent such as alcohols, ketones, ethers, esters, etc., is used together with the non-aqueous solvent in the reaction, or, when the unreacted monomer (A) remains without being polymerization-granulated, it is preferred that the polar solvent or the unreacted monomer is distilled off by heating the reaction mixture to a temperature higher than the boiling point of the polar solvent or the monomer, or is distilled off under reduced pressure.

The non-aqueous dispersion resin (or non-aqueous latex grains) prepared as described above exists as fine grains having a uniform grain size distribution and, at the same time, shows a very stable dispersibility. In particular, even when the liquid developer of the invention containing the non-aqueous dispersion resin grains (or the non-aqueous latex grains) is repeatedly used for a long period of time in a development apparatus, the dispersibility of the resin in the developer is well maintained. Also, even when the developing speed is increased, the re-dispersion of the resin in the liquid developer is easy and no occurrence of stains by sticking of the resin grains to parts of the developing apparatus is observed under such a high load condition.

Also, when the resin grains are fixed by heating, a strong film is formed, which shows that the dispersion resin has an excellent fixability.

Furthermore, even when the liquid developer of this invention is used in the process of a quickened development-fix step using a master plate of a large size, the dispersion stability, the re-dispersibility, and fixability are excellent.

The reason why the re-dispersibility and the fixability of the toner images are remarkably improved as described above in the case of using the resin grains in this invention for the liquid developer has not yet been clarified. However, it has been observed that, even when the oligomer (B) was added after performing the polymerization gradulation without using the oligomer (B), the aforementioned effects were not obtained. Thus, it is considered that in the resin grains of this invention, the oligomer (B) used in the polymerization granulation improves the surface property of the resin grains.

That is, it is considered to be one of the main factors that, during the polymerization granulation carried out in a non-aqueous solvent, the specific polar group bonded only to one terminal of the main chain of the oligomer is adsorbed onto the resin grains by an anchor effect, whereby the main chain portion of the polymer improves the surface property of the resin grains to improve the affinity of the resin grains for the dispersion medium.

The liquid developer of this invention may contain, if desired, a colorant.

There is no specific restriction on the colorant being used, and any conventional pigments or dyes can be used as the colorant in this invention.

When the dispersion resin itself is to be colored, for example, a pigment or dye is physically dispersed in the dispersion resin as one method, and various kinds of pigments and dyes are known, which can be used in the method. Examples of such pigments and dyes include a magnetic iron powder, a lead iodide powder, carbon black, nigrosine, alkali blue, hansa yellow, quinacridone red, and phthalocyanine blue.

As another method of coloring the liquid developer, the dispersion resin may be dyed with a desired dye, for example, as disclosed in JP-A-57-48738. As still other methods, the dispersion resin may be chemically bonded to a dye, for example, as disclosed in JP-A-53-54029; or a previously dye-containing monomer is used in polymerizing granulation to obtain a dye-containing polymer, for example, as disclosed in JP-B44-22955 (the term "JP-B" as used herein means an "examined Japanese patent publication").

Various additives may be added to the liquid developer of the present invention so as to enhance the charging characteristic or to improve the image-forming characteristic. For example, the substances described in Yuji Harasaki, *Electrophotography*, Vol. 16, No. 2, page 44 can be used for such purpose.

Specifically, useful additives include metal salts of 2-ethylhexylsulfosuccinic acid, metal salts of naphthenic acid, metal salts of higher fatty acids, lecithin, poly(vinylpyrrolidone) and copolymers containing half-maleic acid amide component.

The amount of the main constituting components of the liquid developer of the present invention are further explained below.

The amount of the tone grains consisting essentially of a resin and a colorant is preferably from about 0.5 to about 50 parts by weight per 1000 parts by weight of the liquid carrier. If it is less than about 0.5 part by weight, the image density would be insufficient. However, if it is more than about 50 parts by weight, the non-image area would thereby be fogged. In addition, the above-mentioned liquid carrier-soluble resin for enhancing the dispersion stability may also be used, if desired, and it may be added in an amount of from about 0.5 part by weight to about 100 parts by weight per 1000 parts by weight of the liquid carrier. The above-mentioned charge-adjusting agent is preferably used in an amount of from about 0.001 to about 1.0 part by weight per 1000 parts by weight of the liquid carrier. In addition, various additives may also be added to the liquid developer of the present invention, if desired, and the upper limit of the total amount of the additives is to be defined in accordance with the electric resistance of the liquid developer. Specifically, if the electric resistance of the liquid developer, from which to toner grains are removed, is lower than $10^9$ Ωcm, images with good continuous gradation could hardly be obtained. Accordingly, the amounts of the respective additives are required to be properly controlled within the above limitation.

Then, the following examples are intended to illustrate the embodiments of this invention in greater detail but not to limit the scope of this invention in any way.

PRODUCTION EXAMPLE I OF DISPERSION-STABILIZING RESIN: P-1

A mixture of 100 g of octadecyl methacrylate, 2.0 g of divinylbenzene, 150 g of toluene, and 50 g of isopropanol was heated to 80° C. with stirring under nitrogen gas stream and, after adding thereto 5.0 g of 2,2'-azobis(4-cyanovaleric acid) (A.C.V.), the reaction was carried out for 8 hours. After cooling, the reaction mixture was re-precipitated from 2 liters of methanol, and the white powder formed was collected by filtration and dried.

A mixture of 50 g the white powder thus obtained 8.0 g of allyl glycidyl ether, 0.5 g of t butylhydroquinone, 0.5 g of N,N-dimethyldodecylamine, and 100 g of toluene was heated to 100° C with stirring for 20 hours. The reaction mixture was re-precipitated from one liter of methanol, and the light-yellow powder formed was collected by filtration and dried. The amount of the resin obtained was 43 g, and the weight average molecular weight of the product was $9.5\times10^4$.

PRODUCTION EXAMPLES 2 TO 10 OF DISPERSION-STABILIZING RESIN: P-2 TO P-10

By following the same procedure as Production Example 1 except that each of the monomers described in Table 1 below was used in place of octadecyl methacrylate, each of dispersion-stabilizing resins P-2 to P-10 was produced. The weight average molecular weights of the resins obtained were from $9.0\times10^4$ to $0.5\times10^4$.

TABLE 1

| Production Example | Dispersion-Stabilizing Resin | Monomer and Amount | |
|---|---|---|---|
| 2 | P-2 | Dodecyl Methacrylate | 100 g |
| 3 | P-3 | Tridecyl Methacrylate | 100 g |
| 4 | P-4 | Octyl Methacrylate | 50 g |
| | | Dodecyl Methacrylate | 50 g |
| 5 | P-5 | Octedecyl Methacrylate | 80 g |
| | | Butyl Methacrylate | 20 g |
| 6 | P-6 | Dodecyl Methacrylate | 92 g |
| | | N,N-Dimethylaminoethyl Methacrylate | 8 g |
| 7 | P-7 | Octedecyl Methacrylate | 95 g |
| | | 2-(Trimethoxysilyloxy)-ethyl Methacrylate | 5 g |
| 8 | P-8 | Hexadecyl Methacrylate | 100 g |
| 9 | P-9 | Tetradecyl Methacrylate | 100 g |
| 10 | P-10 | Docosanyl Methacrylate | 100 g |

PRODUCTION EXAMPLES 11 TO 23 OF DISPERSION-STABILIZING RESIN: P-11 TO P-23

By following the same procedure as Production Example 1 except that each of the polyfunctional monomers or oligomers shown in Table 2 below was used in place of 2.0 g of divinylbenzene as a crosslinking polyfunctional monomer, each of dispersion-stabilizing resin P-11 to P-23 was produced.

TABLE 2

| Production Example | Dispersion Stabilizing Resin | Crosslinking Monomer or Oligomer | Amount (g) | Weight Average Molecular Weight |
|---|---|---|---|---|
| 11 | P-11 | Ethylene Glycol Dimethacrylate | 2.5 | $10.5\times10^4$ |
| 12 | P-12 | Diethylene Glycol Dimethacrylate | 2.5 | $10\times10^4$ |
| 13 | P-13 | Vinyl Methacrylate | 5 | $9.8\times10^4$ |
| 14 | P-14 | Isopropenyl Methacrylate | 8 | $8.6\times10^4$ |
| 15 | P-15 | Divinyl Adipate | 10 | $8.8\times10^4$ |
| 16 | P-16 | Diallyl Glutaconate | 10 | $9.5\times10^4$ |
| 17 | P-17 | ISP-22GA (trade name, made by Okamura Seiyu K.K.) | 3.0 | $10\times10^4$ |
| 18 | P-18 | Triethylene Glycol Diacrylate | 1.0 | $9.3\times10^4$ |
| 19 | P-19 | Trivinylbenzene | 0.8 | $11.2\times10^4$ |
| 20 | P-20 | Polyethylene Glycol #400 Diacrylate | 3.0 | $9.6\times10^4$ |
| 21 | P-21 | Polyethylene Glycol Dimethacrylate | 3.5 | $10.5\times10^4$ |
| 22 | P-22 | Trimethylolpropane Triacrylate | 2.0 | $12\times10^4$ |
| 23 | P-23 | Polyethylene Glycol #600 Diacrylate | 3.0 | $9.5\times10^4$ |

PRODUCTION EXAMPLE 24 OF DISPERSION-STABILIZING RESIN: P-24

A mixture of 100 g of octadecyl methacrylate, 3 g of thiomalic acid, 4.5 g of divinylbenzene, 150 g of toluene, and 50 g of ethanol was heated to 60° C. with stirring under nitrogen stream. After adding 0.5 g of 2,2'-azobis-(isobutyronitrile) (A.I.B.N.) to the reaction mixture, the reaction was carried out for 5 hours and, after further adding thereto 0.3 g of A.I.B.N., the reaction was carried out for 3 hours. After cooling, the reaction mixture wa re-precipitated from 2 liters of methanol, and the white powder formed was collected by filrtation and dried. The amount of the product was 85 g.

Then, a mixture of 50 g of the aforesaid powder and 100 g of toluene was stirred at 40° C. to dissolve the powder. Then, after adding thereto 0.2 g of t-butylhydroquinone, 8 g of vinyl acetate, and 0.03 g of mercury acetate, the reaction was carried out for 2 hours. Then, the temperature of the system was raised to 70° C. and, after adding thereto $1.2\times10^{-3}$ ml of 100% sulfuric acid, the reaction was carried out for 18 hours. After completion of the reaction, 3.6 g of sodium acetate trihydrate was added to the reaction mixture, followed by stirring for 30 minutes. After cooling, the reaction mixture was re-precipitated from 1.5 liters of methanol to obtain 41 g of a slightly brownish powder. The weight average molecular weight of the powder was $10.5\times10^4$.

PRODUCTION EXAMPLES 25 TO 30 OF DISPERSION-STABILIZING RESIN: P - 25 to P - 30

By following the same procedure as Production Example 24 except that each of the mercapto compounds shown in Table 3 below was used in place of 3 g thiomalic acid, each of dispersion-stabilizing resins P-25 to P-30 was produced.

TABLE 3

| Production Example | Dispersion Stabilizing Resin | Mercapto Compound | | Weight Average Molecular Weight |
|---|---|---|---|---|
| 25 | P-25 | $HSCH_2COOH$ | 2.5 g | $8.8\times10^4$ |
| 26 | P-26 | 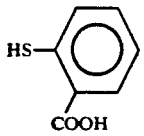 | 3.0 g | $9.5\times10^4$ |
| 27 | P-27 | $HSCH_2CH_2NH(CH_2)_2COOH$ | 3.5 g | $8.5\times10^4$ |
| 28 | P-28 | $HSCH_2CH_2NHCO(CH_2)_2COOH$ | 4.0 g | $9.0\times10^4$ |
| 29 | P-29 | $HSCH_2CH_2OOC(CH_2)_2COOH$ | 4.0 g | $9.5\times10^4$ |
| 30 | P-30 | $HSCH_2CH_2OOC-CH=CH-COOH$ | 4.0 g | $10\times10^4$ |

PRODUCTION EXAMPLE 31 OF DISPERSION STABILIZING RESIN: P-31

By following the same procedure as Production Example 24 except that a mixture of 100 g of dodecyl methacrylate, 4 g of ethylene glycol dimethacrylate, 4 g of thioglycolic acid 2,3-epoxypropyl ester, and 200 g of toluene was used in place of the mixture used in the example, the polymerization reaction was carried out.

Then, 6 g of crotonic acid, 1.0 g of 2,2'-methylenebis-(6-t-butyl-p-cresol), and 0.8 g of N,N-dimethyldodecylamine were added to the reaction mixture, and the reaction was further carried out for 20 hours with stirring at 100° C. The reaction mixture obtained was re-precipitated from 2 liters of methanol, and the light yellow viscous product obtained was collected by a decantation method and dried. The amount of the product was 75 g and the weight average molecular weight thereof was $6.5\times10^4$.

PRODUCTION EXAMPLE 32 OF DISPERSION-STABILIZING RESIN: P-32

A mixture of 100 g of tridecyl methacrylate, 1.2 g of divinylbenzene, and 200 g of tetrahydrofuran was heated to 70° C. with stirring under nitrogen stream and, after adding thereto 6 g of 4,4'-azobis(4-cyanopentanol), the reaction was carried out for 8 hours. Then, after cooling the reaction mixture, 6.2 g of methacrylic anhydride, 0.8 g of t-butylhydroquinone, and one drop of concentrated sulfuric acid were added thereto, and the resulting mixture was stirred for one hour at 30° C. and further stirred for 3 hours at 50° C. After cooling, the reaction mixture was re-precipitated from 2 liters of methanol, and the liquid phase was removed by decantation and a brown viscous material formed was collected and dried. The amount of the product was 88 g and the weight average molecular weight thereof was $11.3\times10^4$.

PRODUCTION EXAMPLE 33 OF DISPERSION-STABILIZING RESIN: P - 33

A mixture of 100 g of octadecyl methacrylate, 1.1 g of ethylene glycol diacrylate, and 200 g of tetrahydrofuran was heated to 70° C. with stirring under nitrogen stream. Then, after adding 5 g of 3,3'-azobis(4-cyanopentanol) to the reaction mixture, the reaction was carried out for 5 hours. After further adding thereto 1.0 g of the aforesaid azobis compound, the reaction was carried out for 5 hours. After cooling the reaction mixture to 20° C. in a water bath, 3.2 g of pyridine and 1.0 g of 2,2'-methylenebis-(6-t-butyl-p-cresol) were added thereto followed by stirring. Then, 4.2 g of methacrylic acid chloride was added dropwise to the reaction mixture over a period of 30 minutes in such a manner that the reaction temperature did not exceed 25° C. The reaction mixture was stirred at 20° C. to 25° C. for 4 hours, and then re-precipitated from a mixture of 1.5 liters of methanol and 0.5 liter of water. The white powder formed was collected by filtration and dried. The amount of the product was 82 g and the weight average molecular weight thereof was $11.2\times10^4$.

PRODUCTION EXAMPLES 34 to 42 OF DISPERSION-STABILIZING RESIN: P-34 to P-42

By following the same procedure as Production Example 33 except that each of the acid chlorides shown in Table 4 below was used in place of methacrylic acid chloride, each of dispersion-stabilizing resins P-34 to P-42 was produced. The weight average molecular weights of the resins were from $10\times10^4$ to $20\times10^4$.

TABLE 4

| Production Example | Dispersion-Stabilizing Resin | Acid Chloride |
|---|---|---|
| 34 | P-34 | $CH_2{=}CH{-}COCl$ |
| 35 | P-35 | $CH_3{-}CH{=}CH{-}COCl$ |
| 36 | P-36 | 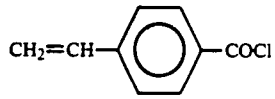 |
| 37 | P-37 | $CH_2{=}CH{-}COOCH_2CH_2COCl$ |
| 38 | P-38 | $CH_2{=}C(CH_3){-}COO(CH_2)_2OCO(CH_2)_2COCl$ |
| 39 | P-39 | $CH_2{=}C(CH_3){-}CONH(CH_2)_2COCl$ |
| 40 | P-40 | 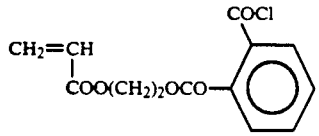 |
| 41 | P-41 | $CH_2{=}C(CH_3){-}COOCH_2CHCl{-}CH_2OCO(CH_2)_3COCl$ |
| 42 | P-42 | $CH_2{=}C(CH_2COOCH_3){-}COCl$ |

PRODUCTION EXAMPLES 43 OF DISPERSION-STABILIZING RESIN: P-43

A mixture of 100 g of dodecyl dimethacrylate, 0.8 g of ethylene glycol methacrylate, and 200 g of tetrahydrofuran was heated to 65° C. under nitrogen gas stream and, after adding thereto 4 g of 2,2'-azobis(4-cyanovaleric acid chloride), the mixture was stirred for 10 hours. The reaction mixture was cooled below 25° C. in a water bath, and 2.4 g of allyl alcohol was added thereto. Then, after adding dropwise to the mixture 2.5 g of pyridine in such a manner that the reaction temperature did not exceed 25° C., the resulting mixture was stirred for one hour as it was. After further stirring the mixture for 2 hours at 40° C., the reaction mixture was reprecipitated from 2 liters of methanol. A light-yellow viscous product thus formed was collected by decantation and dried. The amount thereof was 80 g and the weight average molecular weight was $10.5\times10^4$.

PRODUCTION EXAMPLES 44 TO 52 OF DISPERSION-STABILIZING RESIN: P-44 to P-52

By following the same procedure as production Example 24 except that each of the methacrylates and the polyfunctional monomers shown in Table 5 below were used in place of octadecyl methacrylate and divinylbenzene, each of resins P-44 to P-52 was produced. The weight average molecular weights of the resulting resins were from $9.0\times10^4$ to $12\times10^4$.

TABLE 5

| Production Example | Dispersion Stabilizing Resin | Methacrylate | | Polyfunctional Monomer | |
|---|---|---|---|---|---|
| 44 | P-44 | Dodecyl Methacrylate | 100 g | Divinylbenzene | 4 g |
| 45 | P-45 | Tridecyl Methacrylate | 100 g | Divinylbenzene | 4 g |
| 46 | P-46 | Dodecyl Methacrylate | 100 g | Trivinylbenzene | 1.3 g |
| 47 | P-47 | Octadecyl Methacrylate | 100 g | Ethylene Glycol Dimethacrylate | 5 g |
| 48 | P-48 | Hexadecyl Methacrylate | 100 g | Propylene Glycol Dimethacrylate | 5 g |
| 49 | P-49 | Dodecyl Methacrylate<br>Octadecyl Acrylate | 70 g<br>30 g | Divinylbenzene | 4 g |

TABLE 5-continued

| Production Example | Dispersion Stabilizing Resin | Methacrylate | | Polyfunctional Monomer | |
|---|---|---|---|---|---|
| 50 | P-50 | Octadecyl Methacrylate | 90 g | Ethylene Glycol Diacrylate | 4 g |
| | | Dodecyl Acrylate | 10 g | | |
| 51 | P-51 | Tridecyl Methacrylate | 94 g | Trimethylopropane Trimethacrylate | 1.5 g |
| | | 2-Chloroethyl Methacrylate | 6 g | | |
| 52 | P-52 | Tetradecyl Methacrylate | 90 g | Divinylbenzene | 4 g |
| | | Styrene | 10 g | | |

PRODUCTION EXAMPLE 53 OF DISPERSION STABILIZING RESIN 53: P-53

A mixture of 97 g of octadecyl methacrylate, 3 g of thioglycolic acid, 6 g of divinylbenzene, and 200 g of toluene was heated to 85° C. under nitrogen gas stream. After adding 1.0 g of 2,2'-azobis(cyclohexylcyanamide) (A.B.C.C.) to the reaction mixture, the reaction was carried out for 5 hours and, after further adding thereto 0.6 g of A.B.C.C., the reaction was carried out for 4 hours. After cooling the reaction mixture to 25° C., 6 g of allyl alcohol was added thereto, and a mixture of 8 g of dicyclohexylcarbodiimide (D.C.C.), 0.4 g of 4-(N,N-dimethylamino)pyridine (D.M.A.P.), and 10 g of methylene chloride was added dropwise to the reaction mixture with stirring over a period of 30 minutes followed by performing the reaction. After adding thereto 5 g of formic acid followed by stirring for one hour, insoluble materials were filtered off, and the filtrate was re-precipitated from 3 liters of methanol. The white precipitate formed was collected by filtration and dried. The amount of the resin obtained was 66 g, and the weight average molecular weight of the product was $3.6\times10^4$.

PRODUCTION EXAMPLE 54 OF DISPERSION STABILIZING RESIN: P-54

A mixture of 96 g of hexadecyl methacrylate, 4 g of 2-mercaptoethanol, 7 g of divinylbenzene, 160 g of toluene, and 40 g of ethanol was heated to 80° C. under nitrogen gas stream. Then, after adding 2 g of A.I.B.N. to the reaction mixture, the reaction was carried out for 4 hours and, after further adding thereto 1.0 g of A.I.B.N., the reaction was carried out for 4 hours. The reaction mixture was re-precipitated from 3 liters of methanol, and the precipitate formed was collected by filtration and dried. The amount of the product was 78 g.

A mixture of 5 g of the aforesaid reaction product, 5 g of 4-pentenoic acid, and 150 g of tetrahydrofuran was stirred at 25° C. to dissolve the product. Then, a mixture of 6 g of D.C.C., 0.3 g of D.M.A.P., and 10 g of methylene chloride was added dropwise to the aforesaid solution over a period of 30 minutes, and the resulting mixture was stirred for 5 hours as it was.

Then, 10 g of water was added to the reaction mixture followed by stirring for one hour. The precipitate thus formed was filtered off, and the filtrate was re-precipitated from one liter of methanol. The precipitate thus formed wa collected by filtration and dried. The amount of the product was 38 g, and the weight average molecular weight of the product was $4.0\times10^4$.

PRODUCTION EXAMPLE 1 OF OLIGOMER: OLIGOMER B-1

A mixture of 100 g of methyl methacrylate, 5 g of thioglycol, 150 g of toluene, and 50 g of methanol was heated to 70° C. with stirring under nitrogen gas stream. Then, after adding 1.5 g of 2,2'-azobis(isobutyronitrile) (A.I.B.N.) to the reaction mixture, the reaction was carried out for 4 hours and, after adding thereto 0.4 g A.I.B.N., the reaction was carried out for 4 hours. After cooling, the reaction mixture obtained was re-precipitated from 2 liters of a mixture of methanol/water (4/1 by volume ratio) and, then, the methanol solution .was separated by decantation. The viscous material thus formed was collected and dried to obtain 75 g of a colorless viscous product. The number average molecular weight of the oligomer obtained was 2,800.

PRODUCTION EXAMPLES 2 TO 12 OF OLIGOMER: OLIGOMERS B-2 TO 12

By following the same procedure as Production Example 1 of oligomer except that each of the mercapto compounds shown in Table 6 below was used in place of 5 g of thioglycolic acid, each of oligomers B-2 to B-12 was produced. The number average molecular weights of the oligomers obtained were from 2,500 to 3,500.

TABLE 6

| Production Example of Oligomer | Oligomer | Mercapto Compound | Amount |
|---|---|---|---|
| 2 | B-2 | $HOOC-CH_2-SH$ | 5 g |
| 3 | B-3 | $HOOC-CH(HOOC-CH_2)-SH$ | 4 g |
| 4 | B-4 | $HOCH_2CH_2SH$ | 3 g |
| 5 | B-5 | $H_2NCH_2CH_2SH$ | 3 g |

TABLE 6-continued

| Production Example of Oligomer | Oligomer | Mercapto Compound | Amount |
|---|---|---|---|
| 6 | B-6 | 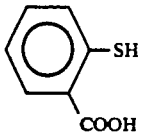 | 5 g |
| 7 | B-7 | 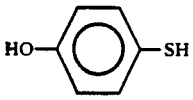 | 4.5 g |
| 8 | B-8 | $HO-H_2C-\underset{\underset{OH}{\vert}}{HC}-H_2C-SH$ | 3 g |
| 9 | B-9 | $HO-\overset{\overset{O}{\Vert}}{\underset{\underset{OH}{\vert}}{P}}-OCH_2CH_2-SH$ | 3 g |
| 10 | B-10 | 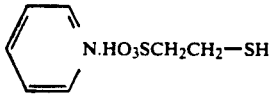 | 4 g |
| 11 | B-11 | $HOOC(CH_2)_2CONH(CH_2)_2SH$ | 5 g |
| 12 | B-12 | 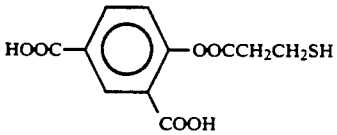 | 5 g |

PRODUCTION EXAMPLES 13 TO 23 OF OLIGOMER: OLIGOMERS B-13 to B-23

By following the same procedure as Production Example 1 of oligomer except that each of the monomers shown in Table 7 below was used in place of methyl methacrylate, each of oligomers B-13 to B-23 was produced. The number average molecular weights of the oligomers were from 2,500 to 3,500.

TABLE 7

| Production Example of Oligomer | Oligomer | Monomer & Amount of Monomer | |
|---|---|---|---|
| 13 | B-13 | Ethyl Methacrylate | 100 g |
| 14 | B-14 | Propyl Methacrylate | 100 g |
| 15 | B-15 | Butyl Methacrylate | 100 g |
| 16 | B-16 | Hexyl Methacrylate | 100 g |
| 17 | B-17 | 2-Ethylhexyl Methacrylate | 100 g |
| 18 | B-18 | Dodecyl Methacrylate | 100 g |
| 19 | B-19 | Tridecyl Methacrylate | 100 g |
| 20 | B-20 | Octadecyl Methacrylate | 100 g |
| 21 | B-21 | Octadecyl Methacrylate | 50 g |
| | | Butyl Methacrylate | 50 g |
| 22 | B-22 | Butyl Methacrylate | 90 g |
| | | Styrene | 10 g |
| 23 | B-23 | Decyl Methacrylate | 95 g |
| | | N,N-Diethylaminoethyl Methacrylate | 5 g |

PRODUCTION EXAMPLE 24 OF OLIGOMER: OLIGOMER B-24

A mixture of 100 g of methyl methacrylate, 150 g of toluene, and 50 g of ethanol was heated to 75° C. with stirring under nitrogen gas stream. Then, after adding 8 g of 2,2'-azobis(cyanovaleric acid) (A.C.V.) to the reaction mixture, the reaction was carried out for 5 hours and, after further adding thereto 2 g of A.C.V., the reaction was carried out for 4 hours. After cooling, the reaction mixture thus obtained was reprecipitated from a mixture of methanol/water (4/1 by volume ratio). The methanol solution was separated by decantation, and the viscous product formed was collected and dried. The amount of the product was 70 g and the number average molecular weight of the oligomer was 2,600.

PRODUCTION EXAMPLES 25 TO 33 OF OLIGOMER: OLIGOMERS B-25 to B-33

By following the same procedure as Production Example 24 of oligomer except that each of the azobis compounds shown in table 8 below was used in place of A.C.V as the polymerization initiator, each of oligomers B-25 to B-33 was produced. The number average molecular weights of the oligomers obtained were from 2,000 to 4,000.

TABLE 8

| | R—N=N—R: Azobis Compound | |
|---|---|---|
| Production Example of Oligomer | Oligomer | Azobis Compound: R— |
| 25 | B-25 | $HO-CH_2-\overset{\overset{CH_3}{\vert}}{\underset{\underset{CN}{\vert}}{C}}-$ |

TABLE 8-continued

| Production Example of Oligomer | Oligomer | R—N=N—R: Azobis Compound: R— |
|---|---|---|
| 26 | B-26 | $HO-CH_2CH_2CH_2-C(CH_3)(CN)-$ |
| 27 | B-27 | $HOCH_2CH_2NHCO-C(CH_3)_2-$ |
| 28 | B-28 | $(HO-CH_2)_2(H_3C)C-NHCO-C(CH_3)_2-$ |
| 29 | B-29 | 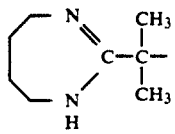 |
| 30 | B-30 | 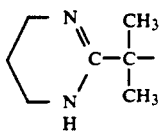 |
| 31 | B-31 | 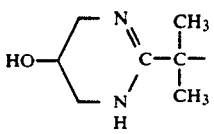 |
| 32 | B-32 | 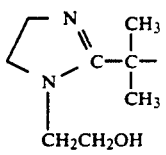 |

TABLE 8-continued

| Production Example of Oligomer | Oligomer | R—N=N—R: Azobis Compound: R— |
|---|---|---|
| 33 | B-33 | 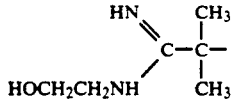 |

PRODUCTION EXAMPLE 34 OF OLIGOMER: OLIGOMER B-34

A mixture of 100 g of 2,3-diacetoxypropyl methacrylate, 5 g of 3-mercaptopropionic acid, 150 g of toluene, and 50 g of methanol was heated to 70° C. with stirring under nitrogen gas stream. Then, after adding 1.5 g of 2,2'-azobis(isobutyronitrile) (A.I.B.N.) to the reaction mixture, the reaction was carried out for 4 hours and, after further adding thereto 0.4 g of A.I.B.N., the reaction was carried out for 4 hours. After cooling, reaction mixture was re-precipitated from 2 liters of a mixture of methanol/water (4/1 by volume ratio), the methanol solution was separated by decantation, and the viscous product formed was collected and dried to obtain 75 g of a colorless viscous product as Oligomer B-34 having the formula shown below. The number average molecular weight of the oligomer was 3,300.

Oligomer B-34:

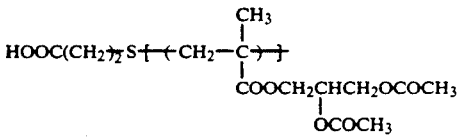

PRODUCTION EXAMPLES 35 TO 46 OF OLIGOMER: OLIGOMERS B-35 to B-46

By following the same procedure as Production Example 34 of oligomer except that each of the mercapto compounds shown in Table 9 below was used in place of 5 g of 3-mercaptopropionic acid, each of oligomers B-35 to B-46 was produced. The number average molecular weights of the oligomers were from 2 500 to 5,000.

TABLE 9

| Production Example of Oligomer | Oligomer | Mercapto Compound | Amount |
|---|---|---|---|
| 35 | B-35 | $HOOC-CH_2-SH$ | 5 g |
| 36 | B-36 | $HOOC-CH(HOOC-CH_2)-SH$ | 4 g |
| 37 | B-37 | $HOCH_2CH_2SH$ | 3 g |
| 38 | B-38 | $H_2NCH_2CH_2SH$ | 3 g |
| 39 | B-39 | 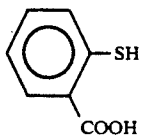 | 5 g |

TABLE 9-continued

| Production Example of Oligomer | Oligomer | Mercapto Compound | Amount |
|---|---|---|---|
| 40 | B-40 | 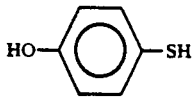 | 4.5 g |
| 41 | B-41 | $HO-H_2C-\underset{\underset{OH}{\vert}}{HC}-H_2C-SH$ | 3 g |
| 42 | B-42 | $HO-\overset{\overset{O}{\Vert}}{\underset{\underset{OH}{\vert}}{P}}-OCH_2CH_2-SH$ | 3 g |
| 43 | B-43 | 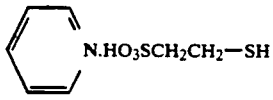 | 4 g |
| 44 | B-44 | $HOOC(CH_2)_2CONH(CH_2)_2SH$ | 5 g |
| 45 | B-45 | 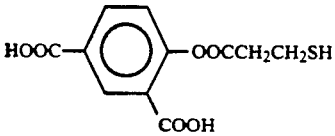 | 5 g |
| 46 | B-46 | 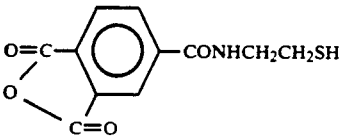 | 6 g |

PRODUCTION EXAMPLES 47 TO 66 OF OLIGOMER: OLIGOMERS B-47 to B-66

By following the same procedure as Production Example 34 except that each of the monomers shown in Table 10 below was used in place of 2,3-diacetoxypropyl methacrylate, each of oligomers B-47 to B-66 was produced. The number average molecular weights of the oligomers obtained were from 2,500 to 3,500.

TABLE 10

$$HOOC\text{-}(CH_2)_2\text{-}S\text{-}[(CH_2-\underset{\underset{COO-R}{\vert}}{\overset{\overset{CH_3}{\vert}}{C}})]$$

| Production Example of Oligomer | Oligomer | —R |
|---|---|---|
| 47 | B-47 | $(CH_2)_2OCOCH_3$ |
| 48 | B-48 | $(CH_2)_2OCOC_4H_9$ |
| 49 | B-49 | $(CH_2)_2OCOC_9H_{19}$ |
| 50 | B-50 | $(CH_2)_2OCO(CH_2)_2COOC_2H_5$ |
| 51 | B-51 | $(CH_2)_2OCO(CH_2)_3COOCH_3$ |
| 52 | B-52 | $(CH_2)_2OCOCH{=}CH-COOC_5H_{11}$ |
| 53 | B-53 | $-CH_2\underset{\underset{OH}{\vert}}{C}HCH_2OOCC_3H_7$ |
| 54 | B-54 | $-CH_2\underset{\underset{OH}{\vert}}{C}HCH_2OOCC_5H_{11}$ |

TABLE 10-continued $$HOOC\text{-}(CH_2)_2\text{-}S\text{-}[(CH_2-\underset{\underset{COO-R}{\vert}}{\overset{\overset{CH_3}{\vert}}{C}})]$$

| Production Example of Oligomer | Oligomer | —R |
|---|---|---|
| 55 | B-55 | $-CH_2\underset{\underset{OCOCH_3}{\vert}}{C}HCH_2OCOCH_3$ |
| 56 | B-56 | $-CH_2\underset{\underset{OCOC_3H_7}{\vert}}{C}HCH_2OCOC_3H_7$ |
| 57 | B-57 | $-CH_2\underset{\underset{OCOC_5H_{11}}{\vert}}{C}HCH_2OCOC_5H_{11}$ |
| 58 | B-58 | $-CH_2\underset{\underset{OCOC_6H_{13}}{\vert}}{C}HCH_2OCOC_6H_{13}$ |
| 59 | B-59 | $-CH_2\underset{\underset{OCOCH_3}{\vert}}{C}HCH_2OCOC_5H_{11}$ |
| 60 | B-60 | $-CH_2\underset{\underset{OH}{\vert}}{C}HCH_2OOC(CH_2)_2COOC_3H_7$ |
| 61 | B-61 | $-CH_2\underset{\underset{OH}{\vert}}{C}HCH_2OOC(CH_2)_3COOCH_3$ |

TABLE 10-continued

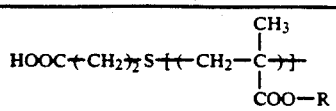

| Production Example of Oligomer | Oligomer | —R |
|---|---|---|
| 62 | B-62 | $-CH_2CHCH_2OOC(CH_2)_3COOC_3H_7$ (OCOCH3) |
| 63 | B-63 | $-CH-CH_2COOCH_3$ (COOCH3) |
| 64 | B-64 | $+CH_2)_2OCO(CH_2)_2SO_2C_4H_9$ |
| 65 | B-65 | $+CH_2)_2OCO(CH_2)_2SO_2C_8H_{17}$ |
| 66 | B-66 | $+CH_2)_6OCOC_2H_5$ |

PRODUCTION EXAMPLE 67 OF OLIGOMER: OLIGOMER B-67

A mixture of 100 g of 2-(n-octylcarbonyloxy)ethyl crotonate, 150 g of toluene, and 50 g of ethanol was heated to 75° C. with stirring under nitrogen gas stream. Then, after adding 8 g of 2,2'-azobis(cyanovaleric acid) (A.C.V.) to the reaction mixture, the reaction was carried out for 5 hours and, after further adding thereto 2 g of A.C.V., the reaction was carried out for 4 hours. After cooling, the reaction mixture was re-precipiated from a mixture of methanol/water (4/1 by volume ratio) and, after separating the methanol solution by decantation, the viscous material formed was collected and dried. The amount of the oligomer was 70 g and the number average molecular weight was 2,600.

Oligomer B-67:

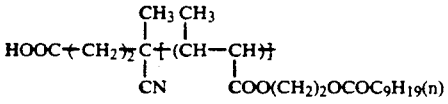

PRODUCTION EXAMPLES 68 TO 76 OF OLIGOMER: OLIGOMERS B-68 to B-76

By following the same procedure as Production Example 67 of oligomer except that each of the azobis compounds shown in Table 11 below was used in place of A.C.V. as, the polymerization initiator, each of oligomers B-68 to B-76 was produced.

The number average molecular weight of the oligomers obtained were from 2,000 to 4,000.

TABLE 11

| Production Example of Oligomer | Oligomer | R—N=N—R: Azobis Compound; Azobis Compound: R— |
|---|---|---|
| 68 | B-68 | $HO-CH_2-C(CH_3)(CN)-$ |
| 69 | B-69 | $HO-CH_2CH_2CH_2-C(CH_3)(CN)-$ |

TABLE 11-continued

| Production Example of Oligomer | Oligomer | R—N=N—R: Azobis Compound; Azobis Compound: R— |
|---|---|---|
| 70 | B-70 | $HOCH_2CH_2NHCO-C(CH_3)_2-$ |
| 71 | B-71 | $(HO-CH_2)_2C(CH_3)-NHCO-C(CH_3)_2-$ |
| 72 | B-72 | 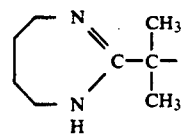 |
| 73 | B-73 | 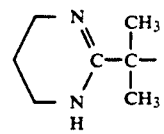 |
| 74 | B-74 | 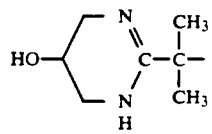 |
| 75 | B-75 | 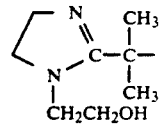 |
| 76 | B-76 | $HOCH_2CH_2NH-C(CH_3)_2-N=$ |

PRODUCTION EXAMPLE 1 OF LATEX GRAINS: D-1

A mixture of 10 g of the dispersion-stabilizing resin P-1, 100 g of vinyl acetate, 1.0 of the oligomer B-1, and 380 g of Isopar H was heated to 70° C. with stirring under nitrogen gas stream and, after adding thereto 0.8 g of 2,2'-azobis(valeronitrile) (A.V.B.N.), the reaction was carried out for 6 hours. Twenty minutes after the addition of the polymerization initiator, the reaction mixture became white-turbid and the reaction temperature raised to 88° C. Then, after rasing the temperature of the system to 100° C., the reaction mixture was stirred for 2 hours to distil off unreacted vinyl acetate. After cooling, the reaction mixture was passed through a 200 mesh nylon cloth to obtain a latex having a mean grain size of 0.23 μm with a polymerization ratio of 88% as a white dispersion.

PRODUCTION EXAMPLES 2 TO 21: LATEXES D-2 to D-21

By following the same procedure a Production Example 1 of latex grains except that each of the oligomers shown in Table 12 below was used in place of the oligomer B-1, each of white dispersions was obtained. The polymerization ratios of the white dispersions were from 85 to 90%. Also, the mean grain sizes of the latexes were in the ranges of from 0.23 to 0.27 μm.

TABLE 12

| Production Example of Latex | Latex | Oligomer |
|---|---|---|
| 2 | D-2 | B-2 |
| 3 | D-3 | B-3 |
| 4 | D-4 | B-4 |
| 5 | D-5 | B-5 |
| 6 | D-6 | B-6 |
| 7 | D-7 | B-7 |
| 8 | D-8 | B-8 |
| 9 | D-9 | B-9 |
| 10 | D-10 | B-10 |
| 11 | D-11 | B-11 |
| 12 | D-12 | B-12 |
| 13 | D-13 | B-13 |
| 14 | D-14 | B-14 |
| 15 | D-15 | B-16 |
| 16 | D-16 | 8-17 |
| 17 | D-17 | B-18 |
| 18 | D-18 | B-20 |
| 19 | D-19 | B-21 |
| 20 | D-20 | B-23 |
| 21 | D-21 | B-24 |

PRODUCTION EXAMPLES 22 TO 35 OF LATEX GRAINS: LATEXES D-22 to D-35

By following the same procedure as Production Example 1 of latex grains except that each dispersion-stabilizing resin and oligomer shown in Table 13 below were used in place of the dispersion-stabilizing resin and the oligomer B-1, each of the white dispersions was produced. The polymerization ratios of the white dispersions obtained were from 85 to 90%.

TABLE 13

| Production Example of Latex | Latex | Dispersion Stabilizing Resin and Amount | | Oligomer and Amount | | Mean Grain Size of Latex (μm) |
|---|---|---|---|---|---|---|
| 22 | D-22 | P-2 | 12 g | B-1 | 1.0 g | 0.22 |
| 23 | D-23 | P-3 | 12 g | B-1 | 1.0 g | 0.20 |
| 24 | D-24 | P-8 | 10 g | B-1 | 1.0 g | 0.22 |
| 25 | D-25 | P-9 | 10 g | B-1 | 1.0 g | 0.24 |
| 26 | D-26 | P-10 | 10 g | B-24 | 1.0 g | 0.22 |
| 27 | D-27 | P-11 | 12 g | B-26 | 1.0 g | 0.22 |
| 28 | D-28 | P-24 | 15 g | B-8 | 1.2 g | 0.21 |
| 29 | D-29 | P-25 | 16 g | B-2 | 0.8 g | 0.20 |
| 30 | D-30 | P-27 | 12 g | B-28 | 0.8 g | 0.20 |
| 31 | D-31 | P-28 | 12 g | B-29 | 0.9 g | 0.20 |
| 32 | D-32 | P-29 | 10 g | B-30 | 1.0 g | 0.26 |
| 33 | D-33 | P-33 | 10 g | B-31 | 0.6 g | 0.21 |
| 34 | D-34 | P-36 | 14 g | B-33 | 0.5 g | 0.24 |
| 35 | D-35 | P-43 | 14 g | B-1 | 0.5 g | 0.22 |

PRODUCTION EXAMPLE 36 OF LATEX GRAINS: LATEX D-36

A mixture of 14 g of the dispersion-stabilizing resin P-44, 100 g of vinyl acetate, 5 g of crotonic acid, 1.0 g of the oligomer B-3, and 468 g of Isopar E was heated to 70° C. with stirring under nitrogen gas stream and, after adding thereto 0.7 g of A.B.V.N., the reaction was carried out for 6 hours. Then, the reaction mixture was stirred for one hour at 100° C. to distil off remaining vinyl acetate. After cooling, the reaction mixture was passed through a 200 mesh nylon cloth to obtain a latex having a mean grain size of 0.23 μm with a polymerization ratio of 85% as a white dispersion.

PRODUCTION EXAMPLE 37 OF LATEX GRAINS: LATEX D-37

A mixture of 16 g of the dispersion-stabilizing resin P-36, 100 g of vinyl acetate, 6.0 g of 4-pentenoic acid, 0.8 g of the oligomer B-15, and 380 g of Isopar G was heated to 70° C. with stirring under nitrogen gas stream. Then, after adding 0.7 g of benzoyl peroxide to the reaction mixture, the reaction was carried out for 4 hours and, after further adding thereto 0.5 g of benzoyl peroxide, the reaction was carried out for 2 hours. After cooling, the reaction mixture was passed through a 200 mesh nylon cloth to obtain a latex having a mean grain size of 0.23 μm as a white dispersion.

PRODUCTION EXAMPLE 38 OF LATEX GRAINS: LATEX D-38

A mixture of 14 g of the dispersion-stabilizing resin P-24, 85 g of vinyl acetate, 15 g of N-vinylpyrrolidone, 1.2 g of the oligomer B-9, and 380 g of n-decane was heated to 75° C. with stirring under nitrogen gas stream. Then, after adding 7 g of A.I.B.N. to the reaction mixture, the reaction was carried out for 4 hours and, after further adding thereto 0.5 g of A.I.B.N., the reaction was carried out for 2 hours. After cooling, the reaction mixture was passed through a 200 mesh nylon cloth to obtain a latex having a mean grain size of 0.24 μm as a white dispersion.

PRODUCTION EXAMPLE 39 OF LATEX GRAINS: LATEX D-39

A mixture of 12 g of the dispersion-stabilizing resin P-37, 100 g of methyl methacrylate, 1.0 g of the oligomer B-19, and 470 g of n-decane was heated to 70° C. with stirring under nitrogen gas stream and, after adding thereto 1.0 g of A.I.B.N., the reaction was carried out for 2 hours. Few minutes after the addition of the polymerization initiator, the reaction mixture began to become blue white-turbid, and the reaction temperature raised to 90° C. After cooling, the reaction mixture was passed through a 200 mesh nylon cloth to obtain a latex having a mean grain size of 0.29 μm as a white dispersion.

PRODUCTION EXAMPLE 40 OF LATEX GRAINS: (COMPARISON EXAMPLE A)

By following the same procedure as Production Example 1 of latex grains except that the oligomer B-1 was omitted, a latex having a mean grain size of 0.25 μm was obtained with a polymerization ratio of 85% as a white dispersion.

PRODUCTION EXAMPLE 41 OF LATEX GRAINS: (COMPARISON EXAMPLE B)

By following the same procedure as Production Example 1 of latex grains except that a mixture of 10 g of the dispersion-stabilizing resin P-1, 100 g of vinyl acetate, 1.0 g of octadecyl methacrylate, and 385 g of Isopar H was used, a latex having a mean grain size of 0.22 μm was obtained with a polymerization ratio of 85% as a white dispersion.

PRODUCTION EXAMPLE 42 OF LATEX GRAINS: (COMPARISON EXAMPLE C)

By following the same procedure as Production Example 1 of latex grains except that a mixture of 18 g of poly(octadecyl methacrylate), 100 g of vinyl acetate, 1 g of a monomer (I) having the following chemical structure, and 385 g of Isopar H was used, a latex having a mean grain size of 0.24 μm was obtained with a polymerization ratio of 86% as a white dispersion.

Monomer (I):

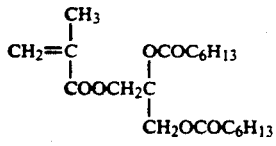

PRODUCTION EXAMPLE 43 OF LATEX GRAINS: LATEX D-43

A mixture of 8 g of the dispersion-stabilizing resin P-1, 100 g of vinyl acetate, 0.8 g of the oligomer B-34, and 380 g of Isopar H was heated to 70° C. with stirring under nitrogen gas stream. Then, after adding 0.8 g of 2,2'-azobis(isovaleronitrile) (A.I.V.N.), the reaction was carried out for 2 hours and, after further adding thereto 0.3 g of A.I.V.N., the reaction was carried out for 2 hours. Twenty minutes after the addition of the polymerization initiator, the reaction mixture became white-turbid and the reaction temperature raised to 88° C. The temperature of the system was raised to 100° C. followed by stirring for 2 hours to distil off remaining vinyl acetate. After cooling, the reaction mixture was passed through a 200 mesh nylon cloth to obtain a latex having a mean grain size of 0.22 μm with a polymerization ratio of 88% as a white dispersion.

PRODUCTION EXAMPLES 44 to 72 OF LATEX GRAINS: LATEXES D-44 to D-72

By following the same procedure as Production Example 43 of latex grains except that each dispersion-stabilizing resin and compound shown in Table 14 below were used in place of the dispersion-stabilizing resin and the oligomer used in the production example, each of latexes was produced. The polymerization ratios of the latex grains were from 85% to 90%.

TABLE 14

| Production Example of Latex | Latex | Dispersion Stabilizing Resin and Amount | | Oligomer and Amount | | Mean Grain Size of Latex (μm) |
|---|---|---|---|---|---|---|
| 44 | D-44 | P-2 | 7 g | B-34 | 1.0 g | 0.20 |
| 45 | D-45 | P-3 | 8 g | B-35 | 1.0 g | 0.21 |
| 46 | D-46 | P-4 | 10 g | B-36 | 0.8 g | 0.20 |
| 47 | D-47 | P-5 | 10 g | B-37 | 1.5 g | 0.23 |
| 48 | D-48 | P-8 | 9 g | B-50 | 1.0 g | 0.20 |
| 49 | D-49 | P-9 | 9 g | B-52 | 0.8 g | 0.19 |
| 50 | D-50 | P-10 | 10 g | B-54 | 0.6 g | 0.18 |
| 51 | D-51 | P-11 | 9 g | B-55 | 1.0 g | 0.24 |
| 52 | D-52 | P-12 | 10 g | B-58 | 2.0 g | 0.23 |
| 53 | D-53 | P-13 | 9 g | B-63 | 1.0 g | 0.21 |
| 54 | D-54 | P-14 | 9 g | B-59 | 0.8 g | 0.20 |
| 55 | D-55 | P-15 | 11 g | B-67 | 1.0 g | 0.22 |
| 56 | D-56 | P-16 | 12 g | B-68 | 1.2 g | 0.25 |
| 57 | D-57 | P-17 | 12 g | B-69 | 1.0 g | 0.24 |
| 58 | D-58 | P-18 | 10 g | B-71 | 1.5 g | 0.24 |
| 59 | D-59 | P-19 | 8 g | B-72 | 0.7 g | 0.22 |
| 60 | D-60 | P-20 | 12 g | B-67 | 1.2 g | 0.18 |
| 61 | D-61 | P-23 | 12 g | B-74 | 1.3 g | 0.20 |
| 62 | D-62 | P-24 | 6 g | B-57 | 1.0 g | 0.17 |
| 63 | D-63 | P-25 | 8 g | B-42 | 1.5 g | 0.18 |
| 64 | D-64 | P-27 | 8 g | B-47 | 0.8 g | 0.17 |
| 65 | D-65 | P-29 | 8 g | B-51 | 1.0 g | 0.17 |
| 66 | D-66 | P-31 | 7 g | B-62 | 1.5 g | 0.17 |
| 67 | D-67 | P-32 | 6 g | B-43 | 0.5 g | 0.20 |

TABLE 14-continued

| Production Example of Latex | Latex | Dispersion Stabilizing Resin and Amount | | Oligomer and Amount | | Mean Grain Size of Latex (μm) |
|---|---|---|---|---|---|---|
| 68 | D-68 | P-41 | 7 g | B-43 | 0.8 g | 0.18 |
| 69 | D-69 | P-25 | 8 g | B-46 | 1.0 g | 0.20 |
| 70 | D-70 | P-49 | 8 g | B-38 | 1.4 g | 0.20 |
| 71 | D-71 | P-50 | 8 g | B-39 | 2.0 g | 0.21 |
| 72 | D-72 | P-54 | 9 g | B-55 | 0.8 g | 0.20 |

PRODUCTION EXAMPLE 73 OF LATEX GRAINS: LATEX D-73

A mixture of 9 g of the dispersion-stabilizing resin P-7, 100 g of vinyl acetate, 1.0 g of the oligomer B-36, and 468 g of Isopar E was heated to 70° C. with stirring under nitrogen gas stream and, after adding thereto 1.3 g of A.I.V.N., the reaction was carried out for 6 hours. Then, the temperature of the system was raised to 100° C. followed by stirring for one hour to distil off remaining vinyl acetate. After cooling, the reaction mixture was passed through a 200 mesh nylon cloth to obtain a latex having a mean grain size of 0.23 μm with a polymerization ratio of 86% as a white dispersion.

PRODUCTION EXAMPLE 74 OF LATEX GRAINS: LATEX D-74

A mixture of 8 g of the dispersion-stabilizing resin P-53, 100 g of vinyl acetate, 6.0 g of pentenoic acid, 0.8 g of the oligomer B-42, and 380 g of Isopar G was heated to 75° C. with stirring under nitrogen gas stream. Then, after adding 0.7 g of A.I.B.N. to the reaction mixture, the reaction was carried out for 4 hours and, after further adding thereto 0.5 g of A.I.B.N., the reaction was carried out for 2 hours. After cooling, the reaction mixture was passed through a 200 mesh nylon cloth to obtain a latex having a mean grain size of 0.20 μm with a polymerization ratio of 88% as a white dispersion.

PRODUCTION EXAMPLE 75 OF LATEX GRAINS: LATEX D-75

A mixture of 9 g of the dispersion-stabilizing resin P-6, 85 g of vinyl acetate, 15 g of N-vinylpyrrolidone, 1.0 g of the oligomer B-72, and 380 g of n-decane was heated to 75° C. with stirring under nitrogen gas stream. After adding 1.7 g of A.I.B.N. to the reaction mixture, the reaction was carried out for 4 hours and, after further adding thereto 0.5 g of A.I.B.N., the reaction was carried out for 2 hours. After cooling, the reaction mixture was passed through a 200 mesh nylon cloth to obtain a latex having a mean grain size of 0.20 μm with a polymerization ratio of 87% as a white dispersion.

PRODUCTION EXAMPLE 76 OF LATEX GRAINS: LATEX D-76

A mixture of 12 g of the dispersion-stabilizing resin P-37, 100 g of isopropyl methacrylate, 0.7 g of the oligomer B-62, and 470 g of n-decane was heated to 70° C. with stirring under nitrogen gas stream and, after adding thereto 1.0 g of A.I.V.N., the reaction was carried out for 2 hours. Few minutes after the addition of the polymerization initiator, the reaction mixture became blue-white turbid, and the reaction temperature raised to 90° C. After cooling, the reaction mixture was passed through a 200 mesh nylon cloth to obtain a latex having a mean grain size of 0.25 μm with a polymerization ratio of 88% as a white dispersion.

PRODUCTION EXAMPLE 77 OF LATEX GRAINS: LATEX D-77

A mixture of 12 g of the dispersion-stabilizing resin P-36, 100 g of styrene, 0.6 g of the oligomer B-52, and 380 g of Isopar H was heated to 60° C. with stirring under nitrogen gas stream. After adding 0.6 g of A.I.V.N. to the reaction mixture, the reaction was carried out for 4 hours and, after further adding thereto 0.3 g of A.I.V.N., the reaction was carried out for 3 hours. After cooling, the reaction mixture was passed through a 200 mesh nylon cloth to obtain a latex having a mean grain size of 0.24 μm with a polymerization ratio of 83% as a white dispersion.

PRODUCTION EXAMPLE 78 OF LATEX GRAINS COMPARISON EXAMPLE D

By following the same procedure as Production Example 43 of latex grains except that the oligomer B-34 was not used, a latex having a mean grain size of 0.25 μm was obtained with a polymerization ratio of 85% as a white dispersion.

PRODUCTION EXAMPLE 79 OF LATEX GRAINS COMPARISON EXAMPLE E

By following the same procedure as Production Example 43 of latex grains except that a mixture of 18 g of poly(octadecyl methacrylate), 100 g of vinyl acetate, 1.0 g of octadecyl methacrylate, and 385 g of Isopar H was used, a latex having a mean grain size of 0.22 μm was obtained with a polymerization ratio of 85% as a white dispersion. (The product corresponds to the latex of JP-A-60-179751).

PRODUCTION EXAMPLES 80 OF LATEX GRAINS COMPARISON EXAMPLE F

By following the same procedure as Production Example 43 of latex grains except that a mixture of 18 g of poly(octadecyl methacrylate), 100 g of vinyl acetate, 1 g of monomer (I') having the following structure, and 385 g of Isopar H was used, a latex having a mean grain size of 0.24 μm was obtained with a polymerization ratio of 86% as a white dispersion. (The latex corresponding to JP-A-62-151868).

Monomer (I'):

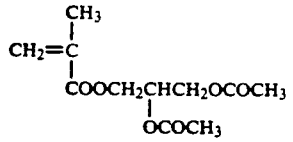

EXAMPLE 1

In a paint shaker (manufactured by Tokyo Seiki K.K.) were placed 10 g of a dodecyl methacrylate/acrylic acid copolymer (copolymerization ratio: 95/5 by weight ratio), 10 g of nigrosine and 30 g of Shellsol 71 together with glass beads, and the mixture was dispersed for 4 hours to obtain a fine dispersion of nigrosine.

Then, by diluting 30 g of the latex D-1 obtained in Production Example 1 of latex grains, 2.5 g of the aforesaid nigrosine dispersion, and 0.08 g of a copolymer of octadecene and octadecylamide semi-maleate with one liter of Shellsol 71, a liquid developer for electrostatic photography was prepared.

Comparison Liquid Developers A, B, and C

Three kinds of comparison liquid developers A, B, and C were prepared in the same manner as above except that each of the latexes shown below were used in place of the latex D-1 used above.

Comparison Liquid Developer A

The latex obtained in Production Example 40 of latex grains was used.

Comparison Liquid Developer B

The latex obtained in Production Example 41 of latex grains was used.

Comparison Liquid Developer C

The latex obtained in Production Example 42 of latex grains was used.

An electrophotographic light-sensitive material, ELP Master II Type (trade name, made by Fuji Photo Film Co., Ltd.) was image-exposed and developed by a full-automatic processor, ELP 404V (trade name, made by Fuji Photo Film Co., Ltd.) using each of the liquid developers thus prepared. The processing (plate-making) speed was 5 plates/minute. Furthermore, after processing 2,000 plates of ELP Master II Type, the occurrence of stains of the developing apparatus by sticking of the toner was observed. The blackened ratio (imaged area) of the duplicated images was determined using 20% original. The results obtained are shown in Table 15 below.

TABLE 15

| Test No. | Liquid Developer | Stains of Developing | Image of the 2,000th Plate |
|---|---|---|---|
| 1 | Developer of Example 1 | No toner residue adhered | Clear |
| 2 | Developer A | Toner residue greatly adhered. | Letter part lost, density of solid black lowered, background portion fogged. |
| 3 | Developer B | Toner residue adhered slightly. | Density of fine lines slightly lowered, Dmax lowered |
| 4 | Developer C | Toner residue adhered | Density of fine lines slightly lowered, Dmax lowered |

Test No. 1: Example of this invention.
Test Nos. 2 to 4: Comparison Examples A to C.

As is clear from the results shown above, when printing plates were produced by the aforesaid processing condition using each of the liquid developers, only the liquid developer according to the present invention caused no stains of the developing apparatus and provided clear images of the 2,000th plate.

Then, the offset printing master plate (ELP Master) prepared using each of the liquid developers was used for printing in a conventional manner, and the number of prints obtained before occurrences of defects of letters on the images of the print, the lowering of the density of the solid black portions of the images, etc., was checked. The results showed that the master plate obtained by using each of the liquid developer of this invention and the liquid developers of Comparison Examples A and C provided more than 10,000 prints without accompanied by the aforesaid failures, while the master plate prepared using the developer of Comparison Example B resulted in the failures after 8,000 prints.

As is clear from the aforesaid results, only the liquid developer according to the present invention could advantageously be used for preparing a large number of prints by the master plate without causing stains on the developing apparatus by sticking of the toner.

On the other hand, in the case of using the liquid developer in Comparison Example A, the developing apparatus was too stained to further use continuously although there was no problem on the number of prints.

Also, in the case of using the liquid developers of Comparison Examples B and C, the developing apparatus was stained (in particular, on the back electrode plate) when the liquid developer was used under the condition of a rapid processing speed as 5 plates/minute (an ordinary processing speed was 2 or 3 plates/minute) and, after the formation of about 2,000 plates, the image quality of the duplicated images on the plate was reduced (reduction of Dmax, lowering of the density of fine lines, etc.). There was no problem on the number of prints by the master plate in the case of using the liquid developer of Comparison Example C but the number thereof was lowered in the case of using the liquid developer of Comparison Example B.

These results clearly show that the resin grains of this invention are excellent over comparative resin grains.

EXAMPLE 2

A mixture of 100 g of the white dispersion (latex grains) obtained in Production Example 2 of latex grains and 1.5 g of Sumikalon Black was heated to 100° C. with stirring for 4 hours. After cooling to room temperature, the reaction mixture was passed through a 200 mesh nylon cloth to remove the remaining dye, thereby a black resin dispersion having a mean grain size of 0.20 μm was obtained.

A liquid developer was prepared by diluting 32 g of the aforesaid black resin dispersion, 0.05 g of zirconium naphthenate, and 15 g of a higher alcohol, FOC-1400 (trade name, made by Nissan Chemical Industries, Ltd.), with one liter of Shellsol 71.

When the liquid developer was applied to the same developing apparatus as in Example 1 for making printing plates, no occurrence of stains of the developing apparatus by sticking of the toner wa observed even after developing 2,000 plates.

Also, the quality of the offset printing master plate obtained was clear and also the image quality of the 10,000 prints formed using the master plate was very clear.

EXAMPLE 3

A mixture of 100 g of the white dispersion obtained in Production Example 36 of latex grains and 3 g of Victoria Blue B was heated to a temperature of from 70° C. to 80° C. with stirring for 6 hours. After cooling to room temperature, the reaction mixture was passed through a 200 mesh nylon cloth to remove the remaining dye, thereby a blue resin dispersion having a mean grain size of 0.16 μm was obtained.

A liquid developer was prepared by diluting 32 g of the aforesaid blue resin dispersion, 0.05 g of zirconium naphthenate, and 15 g of a higher alcohol, FOC-1600 (trade name, made by Nissan Chemical Industries, Ltd.) with one liter of Isopar H.

When the liquid developer was applied to the same developing apparatus as in Example 1 for making printing plates, no occurrence of stains of the developing apparatus by sticking of the toner was observed even after developing 2,000 plates. Also, the image quality of the images on the offset printing master plate obtained was clear and also the image quality of the 10,000th print was very clear.

EXAMPLE 4

A liquid developer was prepared by diluting 32 g of the white resin dispersion obtained in Production Example 3 of latex grains, 2.5 g of the nigrosine dispersion obtained in Example 1, and 0.02 g of a semidocosanylamidated product of a copolymer of diisobutylene and maleic anhydride with one liter of Isopar G.

When the liquid developer was applied to the same developing apparatus as in Example 1 for making printing plates, no occurrence of stains of the developing apparatus by sticking of the toner was observed after developing 2,000 plates. Also, the image quality of the images on the offset printing master plate obtained and the image quality of the 10,000th print obtained using the master plate were very clear.

Furthermore, when the same processing as above wa applied after allowing to stand the liquid developer for 3 months, the results obtained were substantially the same as above.

EXAMPLE 5

In a paint shaker were placed 10 g of poly(decyl methacrylate), 30 g of Isopar H, and 8 g of Alkali Blue together with glass beads, followed by dispersing for 2 hours to obtain a fine dispersion of Alkali Blue.

A liquid developer was prepared by diluting 30 g of the white resin dispersion D-13 obtained in Production Example 13 of latex grains, 4.2 g of the aforesaid Alkali Blue dispersion, 0.06 g of a semidocosanylaminated product of a copolymer of octadecyl vinyl ether and maleic anhydride, and 15, g of a higher alcohol, FOC-1400 with one liter of Isopar G.

When the liquid developer was applied to the same developing apparatus as in Example 1 for making printing plates, no occurrence of stains of the developing apparatus by sticking of the toner was observed even after developing 2000 plates. Also, image quality of the images on the offset printing master plate obtained and the image quality of the 10,000th print obtained using the printing master plate were very clear.

EXAMPLE 6 TO 26

By following the same procedure as Example 5 except that each of the resin grains shown in Table 15 below was used in place of the resin dispersion D-13, each of liquid developers was prepared.

TABLE 16

| Example | Resin Grains of Invention | Example | Resin Grains of Invention |
|---|---|---|---|
| 6 | D-4 | 17 | D-16 |
| 7 | D-5 | 18 | D-17 |
| 8 | D-6 | 19 | D-18 |
| 9 | D-7 | 20 | D-22 |
| 10 | D-8 | 21 | D-25 |
| 11 | D-9 | 22 | D-28 |
| 12 | D-10 | 23 | D-29 |
| 13 | D-11 | 24 | D-32 |
| 14 | D-12 | 25 | D-34 |
| 15 | D-14 | 26 | D-35 |

TABLE 16-continued

| Example | Resin Grains of Invention | Example | Resin Grains of Invention |
|---|---|---|---|
| 16 | D-15 | | |

When each of the liquid developers was applied tot he same developing apparatus as in Example 1 for making printing plates, no occurrence of stains of the developing apparatus by sticking of the toner was observed even after developing 2,000 plates. Also, the image quality of the offset printing plate obtained and the image quality of the 10,000th print obtained using each of the master plates were very clear.

EXAMPLE 27

In a paint shaker (manufactured by Tokyo Seiki K.K.) were placed 10 g of a dodecyl methacrylate/acrylic acid copolymer (copolymerization ratio: 95/5 by weight), 10 g of nigrosine and 30 g of Shellsol 71 together with glass beads followed by dispersing for 4 hours to provide a fine dispersion of nigrosine.

A liquid developer was prepared by diluting 30 g of the resin dispersion D-43 in Production Example of latex grains, 2.5 g of the aforesaid nigrosine dispersion, 15 g of a higher alcohol, FOC-1400 (trade name, made by Nissan Chemical Industries, Ltd.: tetradecyl alcohol), and 0.08 g of a copolymer of octadecene and semimaleic octadecylamide, with one liter of Shellsol 71.

Comparison Liquid Developers D, E, and F

Three kinds of comparison liquid developers D, E, and F were prepared by following the aforesaid method using each of the following resin grains in place of the resin dispersion used above.

Comparison Liquid Developer D

The liquid dispersion in Production Example 78 of latex grains was used.

Comparison Liquid Developer E

The resin dispersion in Production Example 79 of latex grains was used.

Comparison Liquid Developer F

The resin dispersion in Production Example 80 of latex grains was used.

An electrophotographic light-sensitive material, ELP Master II Type (trade name, made by Fuji Photo Film Co., Ltd.) was image-exposed and developed by a full-automatic processor, ELP 404V (trade name, made by Fuji Photo Film Co., Ltd.) using each of the liquid developers. The processing speed was 5 plates/minute. Furthermore, the occurrence of stains of the developing apparatus by sticking of the toner after processing 2,000 plates of ELP Master II Type was checked. The blackened ratio (imaged area) of the duplicated image was determined using 30% original.

The results obtained are shown in Table 17 below.

TABLE 17

| Test No. | Developer | Stains of Developing Apparatus | Image of the 2,000th Plate |
|---|---|---|---|
| 1 | Developer of Example 27 | No toner residue adhered | Clear |
| 2 | Developer D | Toner residue greatly adhered | Letter parts lost, density of solid black portion lowered, background fogged |
| 3 | Developer E | Toner residue adhered slightly | Density of fine lines slightly lowered, Dmax lowered |
| 4 | Developer F | Toner residue adhered slightly | Density of fine lines slightly lowered, Dmax lowered |

Test No. 1: Example of this invention.
Test Nos. 2, 3, and 4: Comparison Examples D, E, and F.

When each of the liquid developers was used for plate-making under the aforesaid processing conditions, only the liquid developer of this invention caused no stains of the developing apparatus and provided clear images on the 2,000th plate.

Then, the offset printing master plate (ELP Master) prepared by processing using each of the liquid developers was used for printing in a conventional manner and the number of prints obtained before the occurrences of defect of letters on the images of the print, lowering of the density of the solid black portions of the images, etc., was checked.

The results showed that the master plate obtained by using each of the liquid developer of this invention and the liquid developers of Comparison Examples D and F gave more than 10,000 prints without accompanied by the aforesaid failures, while the master plate prepared using the liquid developer in Comparison Example E resulted in the failures after 8,000 prints.

As is clear from the aforesaid results, only the liquid developer of this invention using the resin grains in this invention gave no stain of the developing apparatus by sticking of the toner (resin grains) and also in this case, the number of prints by the master plate obtained using the liquid developer was greatly increased.

On the other hand, in the case of using the liquid developer of Comparison Example D, there was no problem on the number of prints but the developing apparatus was too stained to further use continuously.

Also, in the cases of using the liquid developers of Comparison Examples E and F, the developing apparatus was stained (in particular, on the back electrode plate) when the developer was used under the condition of a rapid processing speed of 5 plates/minute, and also after the formation of about 2,000 plates, the image quality of the duplicated images on the plate was reduced (reduction of Dmax, lowering of the density of fine lines, etc.). There was no problem on the number of prints obtained by the master plate in the case of using the liuqid developer of Comparison Example F but the number thereof was reduced in the case of using the liquid developer of Comparison Example E.

These results clearly show that the resin grains in this invention are excellent over comparative resin grains.

EXAMPLE 28

A mixture of 100 g of the white resin dispersion obtained in Production Example 44 of latex grains and 1.5 g of Sumikalon Black was heated to 100° C. with stirring for 4 hours. After cooling to room temperature, the reaction mixture was passed through a 200 mesh nylon cloth to remove the remaining dye to obtain a black resin dispersion having a mean grain size of 0.24 μm.

A liquid developer was prepared by diluting 32 g of the aforesaid black resin dispersion, 20 g of a higher alcohol, FOC-1600 (trade name, made by Nissan Chemical Industries, Ltd.: hexadecyl alcohol), and 0.05 g of zirconium naphthenate, with one liter of Shellsol 71.

When the liquid developer was applied to the same developing apparatus as in Example 27 for platemaking, no occurrence of stains of the developing apparatus by sticking of the toner was observed even after developing 2,000 plates.

Also, the image quality of the offset printing master plate obtained was clear and the image quality of the 10,000th print obtained using the master plate was very clear.

EXAMPLE 29

A mixture of 100 g of the white resin dispersion obtained in Production Example 74 of latex grains and 3 g of Victoria Blue B was heated to a temperature of from 70° C. to 80° C. with stirring for 6 hours. After cooling to room temperature, the reaction mixture was passed through a 200 mesh nylon cloth to remove the remaining dye to obtain a blue resin dispersion having a mean grain size of 0.25 μm.

Then, a liquid developer was prepared by diluting 32 g of the aforesaid blue resin dispersion and 0.05 g of zirconium naphthenate with one liter of Isopar H.

When the liquid developer was applied to the same developing apparatus as in Example 28 for platemaking, no occurrence of stains of the developing apparatus by sticking of the toner was observed even after developing 2,000 plates. Also, the image quality of the images on the offset printing master plate obtained was clear and the image quality of the 10,000th print obtained using the master plate were very clear.

EXAMPLE 30

A liquid developer was prepared by diluting 32 g of the white resin dispersion obtained in Production Example 45 of latex grains, 2.5 g of the nigrosine dispersion obtained in Example 27, 15 g of a higher alcohol, FOC-1800 (trade name, made by Nissan Chemical Industries, Ltd.: octadecyl alcohol), and 0.02 g of a semi-docosanylamidated product of a copolymer of diisobutylene and maleic anhydride, with one liter of Isopar G.

When the liquid developer was applied to the same developing apparatus as in Example 27 for platemaking, no occurrence of stains of the developing apparatus by sticking of the toner was observed. Also, the image quality of the images on the offset printing master plate obtained and the image quality of the 10,000th print obtained using the master plate were clear.

Furthermore, when the liquid developer was allowed to stand for 3 months and applied to the same processing as described above, substantially the same results as above were obtained.

EXAMPLE 31

In a paint shaker were placed 10 g of poly(decyl methacrylate), 30 g of Isopar H, and 8 g of Alkali Blue together with glass beads, followed by dispersing for 2 hours to obtain a fine dispersion of Alkali Blue.

Then, a liquid developer was prepared by diluting 30 g of the white resin dispersion D-65 obtained in Production Example 65 of latex grains, 4.2 g of the aforesaid Alkali Blue dispersion, and 0.06 g of a semi-docosanylamidated product of a copolymer of diisobutyrene and maleic anhydride with one liter of Isopar G.

When the liquid developer was applied to the same developing apparatus as in Example 27 for plate-making, no occurrence of stains of the developing apparatus by sticking of the toner was observed even after developing 2,000 plates. Also, the image quality of the images on the offset printing master plate obtained and the image quality of the 10,000th print obtained using the master plate were very clear.

EXAMPLES 32 to 53

By following the same procedure as Example 31 except that each of the latexes shown in Table 18 below was used in place of the white resin dispersion d-65, each of liquid developers was prepared.

TABLE 18

| Example | Latex Grains | Example | Latex Grains |
|---|---|---|---|
| 32 | D-43 | 43 | D-57 |
| 33 | D-44 | 44 | D-58 |
| 34 | D-46 | 45 | D-59 |
| 35 | D-47 | 46 | D-60 |
| 36 | D-48 | 47 | D-63 |
| 37 | D-49 | 48 | D-64 |
| 38 | D-50 | 49 | D-66 |
| 39 | D-51 | 50 | D-67 |
| 40 | D-52 | 51 | D-71 |
| 41 | D-53 | 52 | D-72 |
| 42 | D-54 | 53 | D-73 |

When each of the liquid developers was applied to the same developing apparatus as in Example 27 for plate-making, no occurrence of stains of developing apparatus by sticking of the toner was observed even after developing 2,000 plates.

Also, the image quality of the images on the offset printing master plates was clear and the image quality of the 10,000th print obtained using each master plates was very clear.

Furthermore, when the liquid developers were allowed to stand for 3 months and each developer was applied to process as above, substantially the same results as above were obtained.

While the invention has been described in detail and with reference to specific embodiments thereof, it will be apparent to one skilled in the art that various changes and modifications can be made therein without departing from the spirit and scope thereof.

What is claimed is:

1. A liquid developer for electrostatic photography comprising resin grains dispersed in a non-aqueous solvent having an electric resistance of at least $10^9$ Ωcm and a dielectric constant of not higher than 3.5, wherein the dispersed resin grains are copolymer resin grains obtained by polymerizing a solution containing at least one kind of a monofunctional monomer (A), which is soluble in said non-aqueous solvent but becomes insoluble therein by being polymerized, in the presence of a dispersion-stabilizing resin soluble in the non-aqueous solvent and an oligomer (B) having a number average molecular weight of not more than $1\times10^4$, said dispersion-stabilizing resin being a polymer containing at least a recurring unit represented by the following formula (I), a part of which has been crosslinked, and having a double bond group copolymerizable with the monofunctional monomer (A) bonded to only one terminal of at least one polymer main chain, and said oligomer (B) being a polymer comprising a recurring unit represented by the following formula (II and having at least one kind of a polar group selected from a carboxy group, a sulfo group, a hydroxy group, a formyl group, an amino group, a phosphono group, and

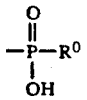

wherein $R^0$ represents a hydrocarbon group having from 1 to 8 carbon atoms or $—OR^1$ (wherein $R^1$ represents a hydrocarbon group having from 1 to 8 carbon atoms) bonded to only one terminal of the main chain of the polymer;

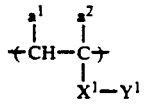

(I)

wherein $X^1$ represents —COO—, —OCO—, $—CH_2OCO—$, $—CH_2COO—$, —O—, or $—SO_2—$; $Y^1$ represents a hydrocarbon group having from 6 to 32 carbon atoms; and $a^1$ and $a^2$, which may be the same or different, each represents a hydrogen atom, a halogen atom, a cyano group, a hydrocarbon group having from 1 to 8 carbon atoms, $—COO—Z^1$ or $—COO—Z^1$ bonded via a hydrocarbon group having from 1 to 8 carbon atoms (wherein $Z^1$ represents a hydrogen atom or a hydrocarbon group having from 1 to 18 carbon atoms);

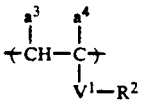

(II)

wherein $V^1$ represents —COO—, —OCO—, $—CH_2)_l—COO—$, $—CH_2)_l—OCO—$, —O—, $—SO_2—$, 13 CONHCOO—, —CONHCONH—,

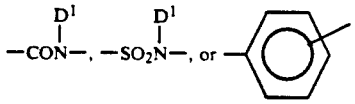

(wherein $D^1$ represents a hydrogen atom or a hydrocarbon group having from 1 to 22 carbon atoms and l represents an integer of from 1 to 3); $R^2$ represents a hydrocarbon group having from 1 to 22 carbon atoms, said $R^2$ may have —O—, —CO—, $—CO_2—$, —OCO—, $—SO_2—$,

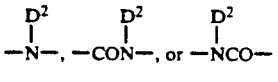

(wherein $D^2$ has the same meaning as $D^1$) in the carbon chain: and $a^3$ and $a^4$, which may be the same or different, each represents a hydrogen atom, a halogen atom, a cyano group, a hydrocarbon group having from 1 to 8 carbon atoms, $—COO—D^3$, or $—COO—D^3$ bonded via a hydrocarbon group having from 1 to 8 carbon atoms (wherein $D^3$ represents a hydrogen atom or a hydrocarbon group having from 1 to 8 carbon atoms which may be substituted).

2. The liquid developer for electrostatic photography as in claim 1, wherein the recurring unit shown by the formula (I) in the oligomer (B) includes a least a recurring unit represented by formula (IIa):

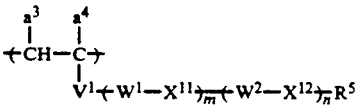

(IIa)

wherein $a^3$, $a^4$, and $V^1$ are same as defined above in formula (II); $R^5$ represents a hydrogen atom or a hydrocarbon group having from 1 to 22 carbon atoms; $X^1$ and $X^2$, which may be the same or different, each represents —O—, —CO—, $—CO_2—$, $—SO_2—$,

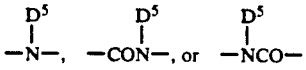

(wherein $D^5$ has the same meaning as $D^1$ in formula (II)); $W^1$ and $W^2$, which may be the same or different, each represents a hydrocarbon group having from 1 to 18 carbon atoms, which may be substituted or may have in main chain

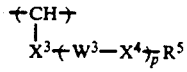

wherein $X^3$ and $X^4$, which may be the same or different, each has the same meaning as aforesaid $X^{11}$ and $X^{12}$; and $W^3$ represents a hydrocarbon group having from 1 to 18 carbon atoms, which may be substituted; and m, n, and p each represents a integer of from 0 to 3, with the proviso that m, n and p cannot be 0 at the same time.

3. The liquid developer for electrostatic photography as in claim 1, wherein said dispersion stabilizing resin contains the monomer corresponding to the recurring unit represented by formula (I) at a proportion of at least 30 parts by weight per 100 parts by weight of the whole monomers of said dispersion-stabilizing resin.

4. The liquid developer for electrostatic photography as in claim 1, wherein said dispersion stabilizing resin has a weight average molecular weight of from $1\times10^4$ to $1\times10^6$.

5. The liquid developer for electrostatic photography as in claim 1, wherein said monofunctional monomer (A) is represented by formula (V):

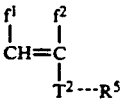

(V)

wherein $T^2$ represents —COO—, —OCO—, $—CH_2OCO—$, $—CH_2COO—$, —O—,

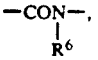

$—SO_2N—$or

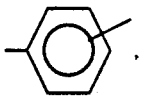

wherein $R^6$ represents a hydrogen atom or an substituted, $R^5$ represents a hydrogen atom or an aliphatic group having from 1 to 6 carbon atoms which may be substituted, and $f^1$ and $f^2$, which may the same or different, each represents a hydrogen atom, a halogen atom, a cyano group, a hydrocarbon group having 1 to 8 carbon atoms, —COO—$D^3$, or —COO—$D^3$ bonded via a hydrocarbon group having from 1 to 8 carbon atoms wherein $D^3$ represents a hydrogen atom or a hydrocarbon group having from 1 to 8 carbon atoms which may be substituted.

6. The liquid developer for electrostatic photography as in claim 1, wherein said oligomer has a number average molecular weight of from $1\times10^3$ to $1\times10^4$.

7. The liquid developer for electrostatic photography as in claim 1, wherein said oligomer contains a recurring unit represented by formula (II) at a proportion of from 30% to 100% by weight.

8. The liquid developer for electrostatic photography as in claim 1, wherein said oligomer is used in an amount of from 0.05 to 10% by weight with respect to the amount of the monomer (A).

9. The liquid developer for electrostatic photography as in claim 1, wherein said liquid developer further contains a colorant.

* * * * *